US007234329B2

(12) United States Patent
Mazolf et al.

(10) Patent No.: US 7,234,329 B2
(45) Date of Patent: Jun. 26, 2007

(54) LOCK SYSTEM FOR MOVABLE CLOSURE ELEMENT

(75) Inventors: Ricci L. Mazolf, New Hampton, IA (US); Martin John Playford, Dorrington (GB)

(73) Assignee: Tri/Mark Corporation, New Hampton, IA (US)

( * ) Notice: Subject to any disclaimer, the term of this patent is extended or adjusted under 35 U.S.C. 154(b) by 67 days.

(21) Appl. No.: 10/811,692

(22) Filed: Mar. 29, 2004

(65) Prior Publication Data

US 2005/0211535 A1 Sep. 29, 2005

(51) Int. Cl.
*E05B 47/00* (2006.01)

(52) U.S. Cl. ..... 70/277; 70/208; 292/336.3

(58) Field of Classification Search ..... 70/208, 70/210, 257, 277, DIG. 30; 292/336.3, DIG. 31
See application file for complete search history.

(56) References Cited

U.S. PATENT DOCUMENTS

| | | | | | |
|---|---|---|---|---|---|
| 4,554,808 | A * | 11/1985 | Escaravage | 70/279.1 |
| 5,927,773 | A * | 7/1999 | Larsen et al. | 292/337 |
| 5,941,104 | A * | 8/1999 | Sadler | 70/208 |
| 5,983,682 | A * | 11/1999 | Parikh | 70/208 |
| 5,987,942 | A * | 11/1999 | Ichinose | 70/208 |
| 5,987,943 | A * | 11/1999 | Verga et al. | 70/208 |
| 6,048,006 | A * | 4/2000 | Antonucci et al. | 292/336.3 |
| 6,181,024 | B1 * | 1/2001 | Geil et al. | 307/10.2 |
| 6,406,075 | B1 * | 6/2002 | Rice et al. | 292/336.3 |
| 6,513,354 | B2 * | 2/2003 | Predd et al. | 70/208 |
| 6,523,869 | B1 * | 2/2003 | Jensen et al. | 292/336.3 |
| 6,604,393 | B2 * | 8/2003 | Larsen et al. | 70/208 |
| 6,708,537 | B1 * | 3/2004 | Eschweiler et al. | 70/208 |
| 6,854,304 | B2 * | 2/2005 | Linares | 70/208 |
| 2005/0115289 | A1 * | 6/2005 | Talukdar et al. | 70/208 |

FOREIGN PATENT DOCUMENTS

| | | |
|---|---|---|
| EP | 0 540 902 | 5/1993 |
| EP | 1 059 407 | 12/2000 |
| GB | 1040692 | 9/1966 |
| GB | 1292246 | 10/1972 |
| GB | 2144794 | 3/1985 |
| GB | 2397618 | 7/2004 |

* cited by examiner

*Primary Examiner*—Suzanne Dino Barrett
(74) *Attorney, Agent, or Firm*—Wood Phillips, Katz, Clark & Mortimer

(57) ABSTRACT

A lock system for releasably maintaining a movable closure element in one of two different positions. The lock system has a latching assembly with a first state and a second, maintaining state. An actuating system has a first actuating assembly that is changeable from a first state into a second state by movement of a part of the first actuating assembly in an operating path. A blocking assembly in a first state allows the first actuating assembly to be changed from the first state into the second state. The blocking assembly in a second state blocks the operating path to prevent the part of the first actuating assembly from moving so as to allow the first actuating assembly from being changed from the first state into the second state.

39 Claims, 21 Drawing Sheets

FIG. 3
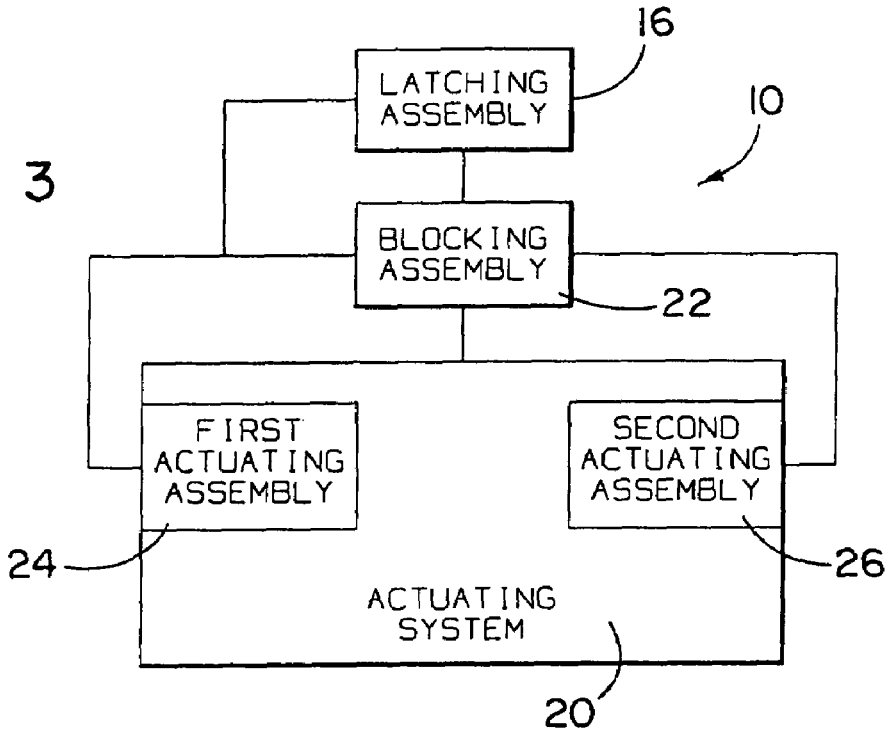
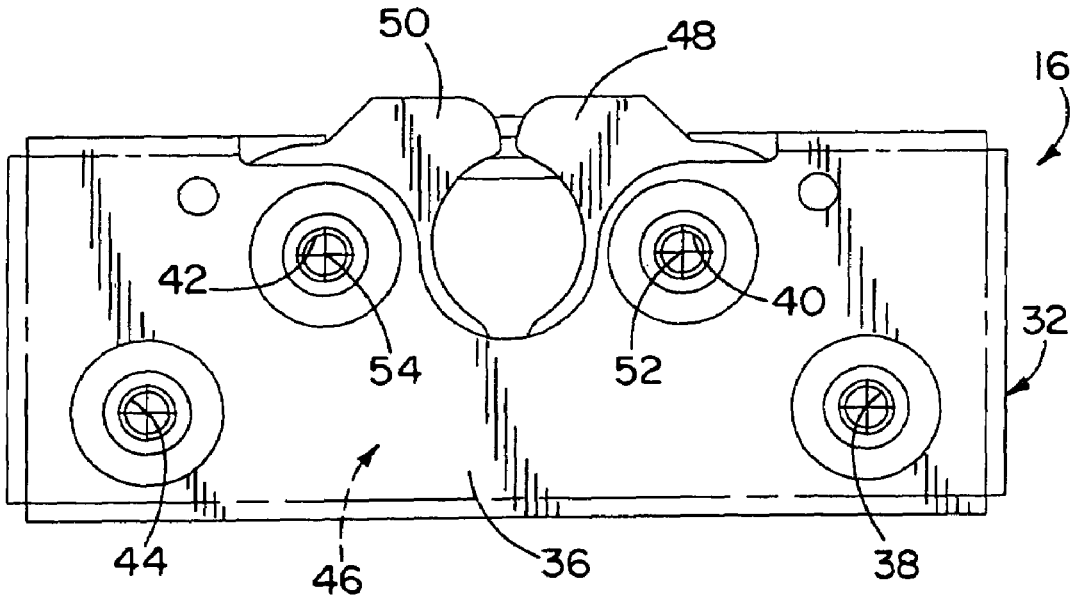
FIG. 5

LOCK SYSTEM FOR MOVABLE CLOSURE ELEMENT

BACKGROUND OF THE INVENTION

1. Field of the Invention

This invention relates to lock systems, as used to releasably maintain a movable closure element in a predetermined position therefor.

2. Background Art

Lock systems are utilized in many different environments for both static and dynamic applications. One exemplary lock system utilizes one or more U-shaped rotors which are designed to cooperate with a strike element on a support upon which a movable closure element is mounted and relative to which the movable element is movable through pivoting or translation. In a paired rotor construction, each of the rotors has a similar construction and is mounted to a housing for pivoting movement between a latched position and a release position. The rotors are normally spring biased towards their release positions. As the movable closure element is moved towards a predetermined position in which it is to be releasably maintained, the strike element encounters the rotors and causes them to be pivoted against the spring bias force into their latched positions, in which cooperatively captively engage the strike element. A catch assembly cooperates with the rotors, and in a first state maintains the rotors in their latched positions. By changing the catch assembly from the first state into a second state, through repositioning of at least the element on the catch assembly, the rotors are allowed to pivot, under the spring bias force, towards their release positions, thereby allowing separation of the rotors from the strike element, and repositioning of the associated closure element.

Various means have been devised for changing the state of the catch assembly from opposite sides of the movable closure element. It is known, for example, to change the state of the catch assembly utilizing a push button actuator, which is translatable to move a part of the catch assembly to change the state thereof.

In one design, the push button actuator is integrated into a housing defining a handle which can be grasped to a) provide leverage to the user to actuate the push button actuator as through the thumb and b) facilitate controlled movement of the movable closure element. Commonly, the push button actuator is locked relative to the housing through cooperating structure on the push button actuator and housing that blocks translational movement of the push button actuator through a range necessary to change the state of the catch assembly. Typically, the push button actuator is locked through the use of a conventional keying arrangement.

In certain environments, it is desirable to be able to unlock the push button actuator without requiring use of the key, as through a second actuating assembly. The second actuating assembly may be on the same side of the movable closure element as the push button actuator is on, or on the opposite side. As one example, on motor vehicles, it is known to unlock an actuating assembly through an electromechanical mechanism that may be operated, as by a keypad. In some environments, it is desirable to use a wireless transmitter to generate a signal to cause unlocking of an actuating assembly to permit operation thereof without requiring use of a key. For example, in the automotive industry, it is common to use key fobs with an integrated transmitter. In still other environments, a wired switch may be used for this purpose.

Heretofore, particularly with actuating assemblies operable utilizing a push button actuator, it has been impractical to unlock the actuating system other than through use of an operating key for the push button actuator. The housing/handle configuration has geometrical constraints which do not allow incorporation of structure for actuation independent of the keyed mechanism. In certain environments, there is a need for an actuating system, with a push button actuator, that can be locked and unlocked through separate actuating assemblies that may have a construction that has one, or a combination, of mechanical and electromechanical components, with the latter potentially operated in response to a signal generated through either a wired or wireless transmission means.

SUMMARY OF THE INVENTION

In one form, the invention is directed to a lock system for releasably maintaining a movable closure element in one of two different positions for the movable closure element relative to a support for the movable closure element. The lock system has a latching assembly with a first state and a second state. The latching assembly in the first state is releasably engageable with a part of the support to thereby releasably maintain the movable closure element with which the lock system is associated in the one position. The latching assembly has a first element that is changed from the first position into a second position to thereby cause the latching assembly to be changed from the first state into the second state, whereupon the movable closure element with which the lock system is associated can be moved from the one position into the other of the two different positions. The lock system further includes an actuating system for the latching assembly. The actuating system has a first actuating assembly that is changeable from a first state into a second state by movement of a part of the first actuating assembly in an operating path to thereby cause the first element to be changed from the first position into the second position. The actuating system further has a blocking assembly having a first state and a second state. The blocking assembly in the first state allows the first actuating assembly to be changed from the first state into the second state. The blocking assembly in the second state blocks the operating path to prevent the part of the first actuating assembly from being changed from the first position into the second position and thereby the first actuating assembly from being changed from the first state into the second state.

The lock system may be provided in combination with a movable closure element upon which the lock system is operatively mounted.

The lock system may be further provided in combination with a support relative to which the movable closure element is mounted for movement between the two different positions.

In one form, the support has a strike assembly with a part that is releasably engaged by the latch assembly with the latch assembly in the first state to thereby releasably maintain the movable closure element in the one position.

The latching assembly may have at least one rotor with a receptacle for the part of the strike assembly. The at least one rotor is pivotable around an axis between a latched position and a release position. The at least one rotor is in the latched position with the latching assembly in the first state and in the release position with the latching assembly in the second state.

The actuating system may include a second actuating assembly for changing the blocking assembly between the first and second states.

The second actuating assembly may be operable to change the blocking assembly between the first and second states in response to transmission of an electrical signal from an input.

In one form, the second actuating assembly has a drive that is operable in response to a transmission of the electrical signal from the input to the first actuator.

In one form, the input includes a keypad.

The input may include a wireless transmitter for generating the electrical signal.

The input may be a wired switch.

In one form, the first actuating assembly has a push button actuator that is movable from a normal position into an actuated position to change the first actuating assembly from the first state into the second state.

The part of the first actuating assembly may be translated in the operating path to drive the first element from the first position into the second position.

In one form, the first actuating assembly is changeable from the first state into a third state to thereby change the blocking assembly from the second state into the first state.

The first actuating assembly may be changeable from the first state into a fourth state to thereby change the blocking assembly from the first state into the second state.

The actuating system may include a second actuating assembly for changing the blocking assembly between the first and second states.

In one form, the push button actuator is movable from the normal position into the actuated position along a first line, with the first actuating assembly changeable from the first state into the third state by pivoting movement of the push button actuator around a first axis that is substantially parallel to the first line.

The first actuating assembly may include a cam element that engages a first surface on the blocking assembly and changes the blocking assembly from the second state into the first as an incident of the first actuating assembly changing from the first state into the third state.

The blocking assembly may include a plate that is pivotable about a second axis which is substantially parallel to the first axis between a first position with the blocking assembly in the first state and a second position with the blocking assembly in the second state.

In one form, the plate has wall with a surface residing substantially in a first plane, and the first surface projects angularly away from the first plane.

The blocking assembly may include a second surface that projects angularly away from the first plane and is spaced from and faces the first surfaces. The cam element engages the second surface and changes the blocking assembly from the first state into the second state as an incident of the first actuating assembly changing from the first state into a fourth state wherein the plate is in the second position.

In one form, with the blocking assembly in the first state, the part of the first actuating assembly is movable along the first line towards and past the first plane to engage and cause the first element to be changed from the first position into the second position as the push button actuator is moved from the normal position into the actuated position.

In one form, with the blocking assembly in the second state, the part of the first actuating assembly is blocked by the plate wall from moving in the operating path to cause the first element to be changed from the first position into the second position.

The cam element may project in cantilever fashion away from the first axis in a direction transverse to the first line.

In one form, a portion of the first actuating assembly is pivotable around the first axis to change the first actuating assembly from the first state into the third state.

A portion of the first actuating assembly may be a) pivotable around the first axis in a first-direction to change the first actuating assembly from the first state into the third state and b) pivotable around the first axis in a direction opposite to the first direction to change the first actuating assembly from the first state into the fourth state.

The portion of the first actuating assembly may include the push button actuator.

The push button actuator may be pivoted around the first axis in the first direction to a first position to change the first actuating assembly from the first state into the third state and in a direction opposite to the first direction to a second position to change the first actuating assembly from the first state into the fourth state. The push button actuator is spring biased to a resting position between the first and second positions.

In one form, the push button actuator has an associated key operated cylinder that moves guidingly within a case and with a key operatively inserted in the cylinder, the push button actuator can be pivoted between the first and second positions.

In one form, the key can be removed from the cylinder with the push button actuator in the third position and cannot be removed from the cylinder with the push button actuator in either the first and third positions.

The first actuating assembly may further include a housing, with the push button actuator mounted for movement relative to the housing between the normal position and actuated position. The push button actuator and housing are keyed to each other against relative movement around the first axis.

In one form, the push button actuator and housing are selectively keyed to each in two different relative positions against relative pivoting around the first axis.

In one form, the housing defines a graspable handle.

The first actuating system may be defined as a self-contained module that is separate from the blocking assembly.

The invention is further directed to a lock system for releasably maintaining a movable closure element in one of two different positions for the movable closure element relative to a support for the movable closure element. The lock system has a latching assembly with a first state and a second state. The latching assembly in the first state is releasably engageable with a part of the support to thereby releasably maintain the movable closure element with which the lock system is associated in the one position. The latching assembly may include a first element that is changed from a first position into a second position to thereby cause the latching assembly to be changed from the first state into the second state, whereupon a movable closure element with which the lock system is associated can be moved from the one position into the other of the two different positions. The lock system further includes an actuating system for the latching assembly. The actuating system has a first actuating assembly that is changeable from a first state into a second state by movement of part of the first actuating assembly in an operating path to thereby cause the first element to be changed from the first position into the second position. The actuating system may further include a blocking assembly having a first state and a second state. The blocking assembly in the first state allows the first actuating assembly to be changed from the first state into the second state. The blocking assembly in the second state blocks the operating path to prevent the part of the first actuating assembly from being changed from the first position into the second position and thereby the first actuating assembly from being changed from the first state into the second state. The actuating system may further include a second actuating assembly for changing the blocking assembly between the first and second states. The part of the first actuating assembly is translated in the operating path to drive the first element from the first position into the second position.

In one form, the first actuating system comprises a self-contained module that is separate from the blocking assembly.

In one form, the self-contained module can be installed as a unit and is operably assembled with the blocking assembly without requiring any separate fastener acting between the blocking assembly and first actuating assembly.

In one form, the first actuating assembly and blocking assembly are changeable from a fully separated state into an operably assembled state by relative translational movement between the first actuating assembly and blocking assembly.

In one form, the first actuating assembly comprises a push button actuator.

BRIEF DESCRIPTION OF THE DRAWINGS

FIG. 3 is a schematic representation as in FIG. 2 wherein a second actuating assembly is incorporated to operate the blocking assembly;

FIG. 5 is an enlarged, elevation view of the latching assembly in FIGS. 1–4 from one side thereof;

DETAILED DESCRIPTION OF THE DRAWINGS

Figure 1:
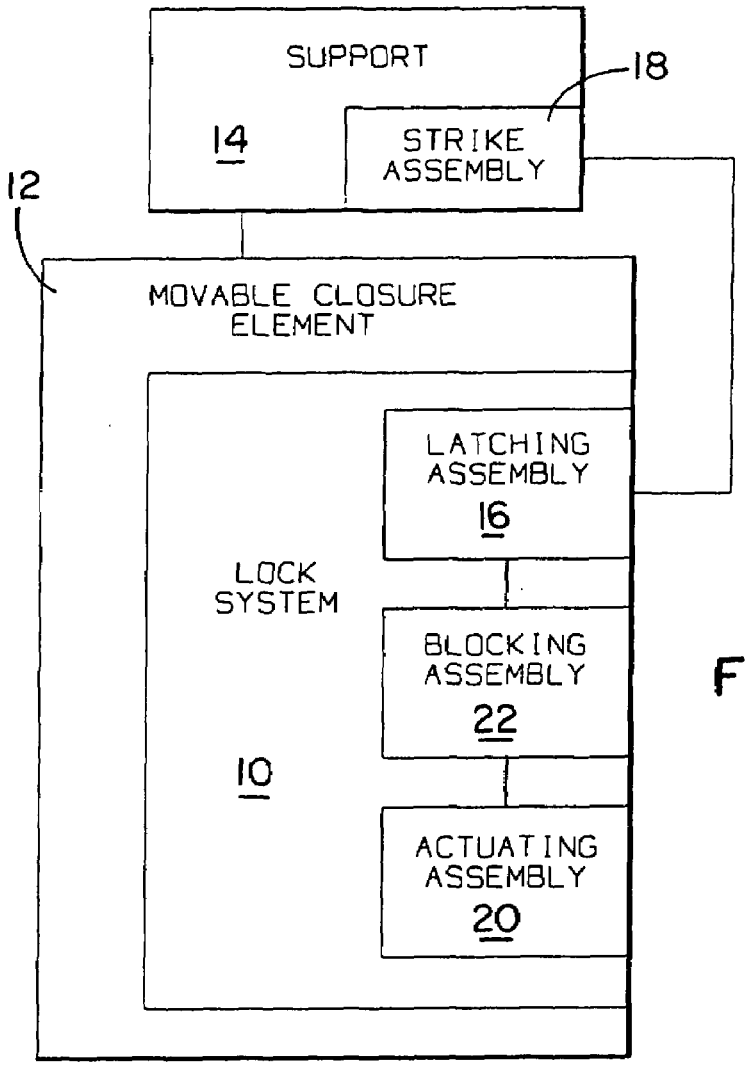
FIG. 1 is a schematic representation of a lock system, according to the present invention, operatively associated with a movable closure element that is movable relative to a support between different positions, with the lock system including a latching assembly which is engageable with a strike assembly on the support to releasably maintain the movable closure element in one predetermined position therefor.

In FIG. 1, a lock system, according to the present invention, is shown schematically at 10. The lock system 10 is designed to maintain a movable closure element 12 in one of two different positions for the movable closure element 12 relative to a support 14 for the movable closure element 12. The nature of the movable closure element 12, and the support 14 therefor, is not critical to the present invention. The invention contemplates use of the lock system 10 in virtually any type of static or dynamic environment in which a repositionable element is movable between at least two different positions and is required to be releasably held in one of the two different positions. For purposes of illustration herein, the repositionable element will be characterized as a "movable closure element", with it being understood that the invention is not limited technically to a "closure". Further, the manner of attachment of the movable closure element 12 to the support 14 is not critical to the present invention. The movable closure element 12 may be translated, pivoted, or otherwise repositioned relative to the support 14 between at least the two different positions.

The lock system 10 consists of a latching assembly 16 that is releasably engageable with a strike assembly 18 on the support 14 to thereby releasably maintain the movable closure element 12 in one predetermined position. An actuating system 20 is provided to change the latching assembly 16 from a first state, wherein it releasably engages the strike assembly 18 to thereby releasably maintain the movable closure element 12 in the one predetermined position, and a second state, wherein the movable closure element 12 can be repositioned from the one position into the other of the two different positions. A blocking assembly 22 has first and second states.

Figure 2:
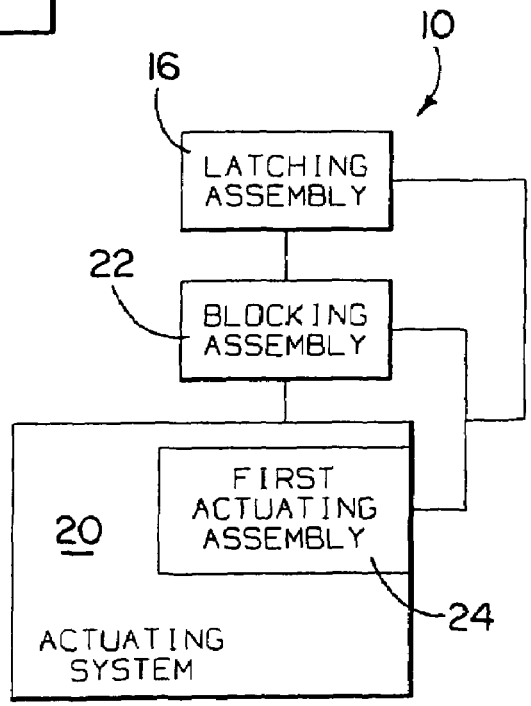
FIG. 2 is a schematic representation of the lock system in FIG. 1 with a single actuating assembly for a blocking assembly through which the lock system is changed between and unlocked states.

As seen in FIG. 2, in one form, the actuating system 20 includes a first actuating assembly 24 to be changed from a first state into a second state so as to thereby cause the latching assembly 16 to be changed from its first state into its second state. With the blocking assembly 22 in the first state, the first actuating assembly 24 can be changed from its first state into its second state to thereby cause the latching assembly 16 to be changed from its first state into its second state. With the blocking assembly 22 in its second state, the blocking assembly 22 prevents the first actuating assembly 24 from being changed from its first state into its second state to thereby change the latching assembly 16 from its first state into its second state.

As shown in FIG. 3, the invention also contemplates that a second actuating assembly 26 may be provided on the actuating system 20 to change the blocking assembly 22 selectively between the first and second states therefor.

The schematic showing of elements in FIGS. 1–3 is made to generically identify the cooperative arrangement of elements contemplated by the invention. The inventive embodiments described below are intended to be but exemplary of specific constructions and interactions of the elements shown generically in FIGS. 1–3.

Figure 4:
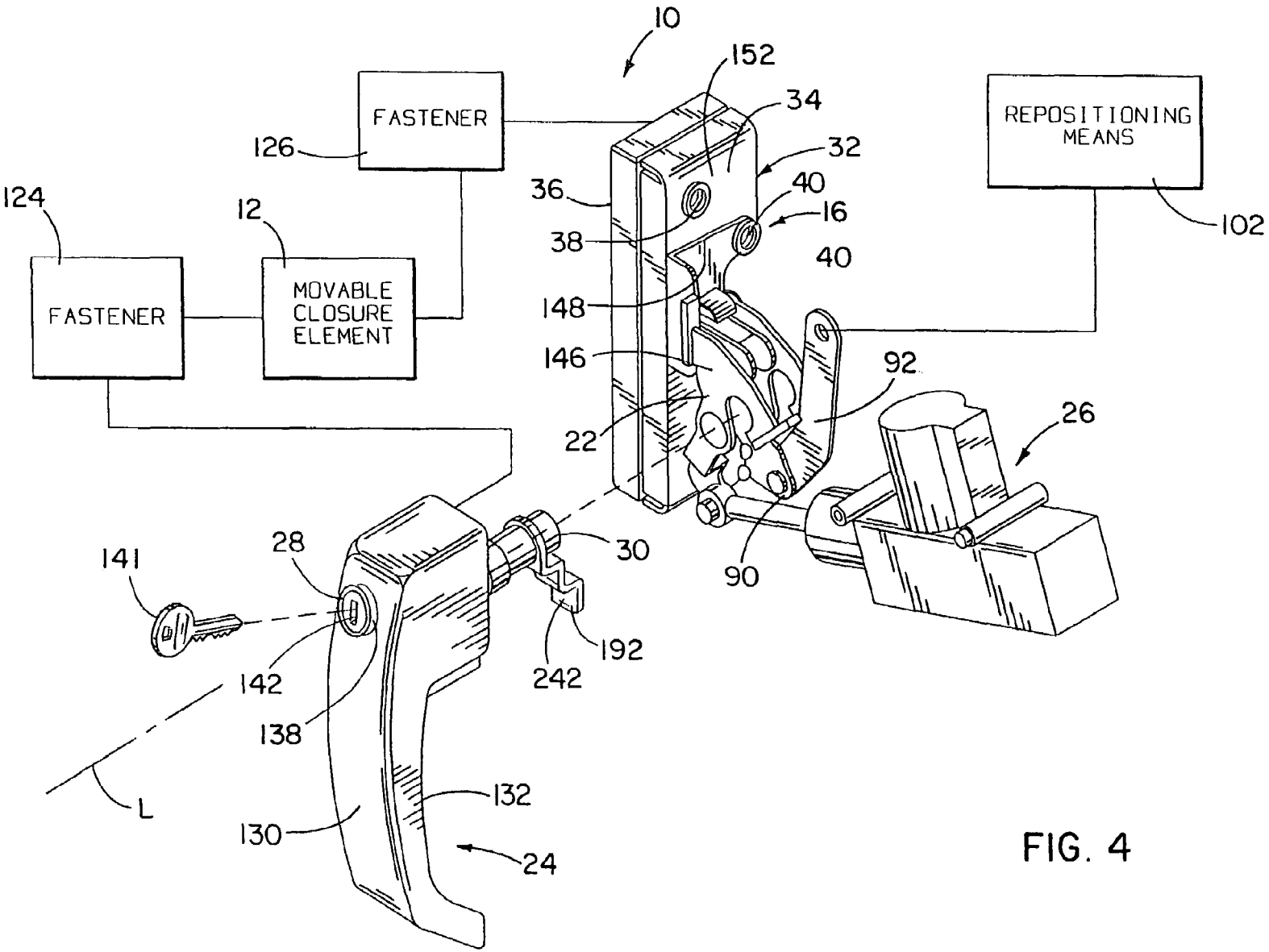
FIG. 4 is an exploded, partially schematic representation of the lock system of FIG. 3 in relationship to a movable closure element.

As seen in FIG. 4, one form of the lock system 10 is shown to include the latching assembly 16, blocking assembly 22, first actuating assembly 24, and second actuating assembly 26, operatively mounted upon a movable closure element 12 . The first actuating assembly 24 includes a push button actuator 28 that is translatable along a line L between a normal position, shown in FIG. 4, and an actuated position, as shown in other figures and explained in detail. hereinbelow, to cause the free end 30 on the push button actuator 28 to move in an operating path so as to cause the latching assembly 16 to be changed from the first state into the second state.

Details of the latching assembly 16 are shown additionally in FIGS. 5–9. The latching assembly 16 consists of a housing 32 defined by rectangular, cup-shaped first and second housing parts 34, 36 joined conventionally through, in this case four, axles 38, 40, 42, 44, to cooperatively produce a component operating space 46.

Figure 8:
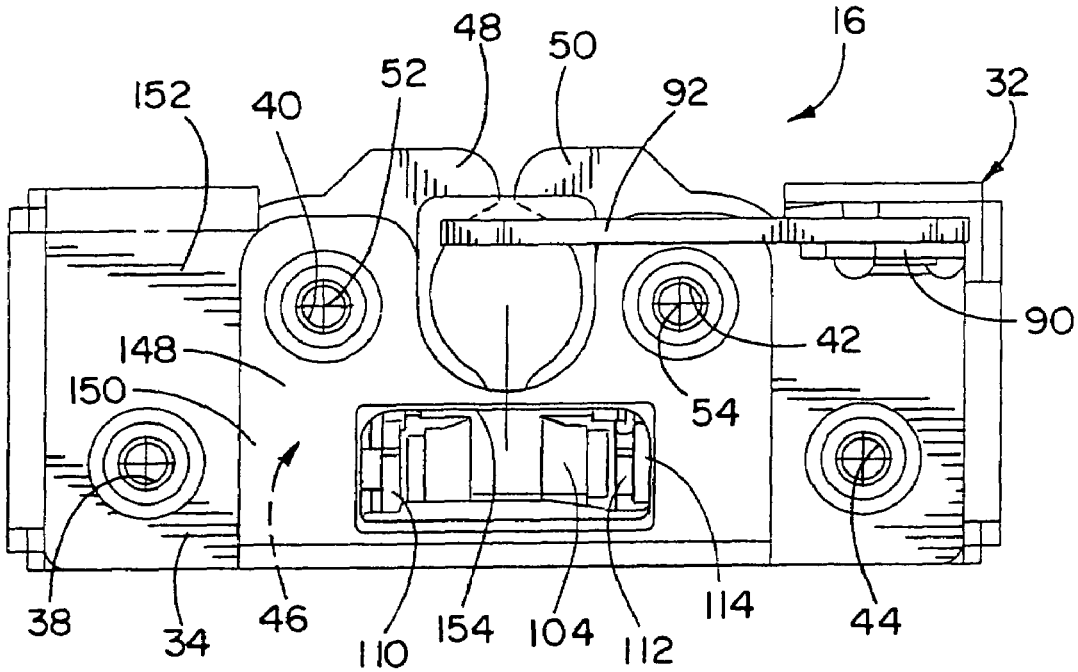
FIG. 8 is an elevation view corresponding to that in FIG. 6 with the housing part assembled and showing a trip actuator that is operable to change the state of the latching assembly.
Figure 9:
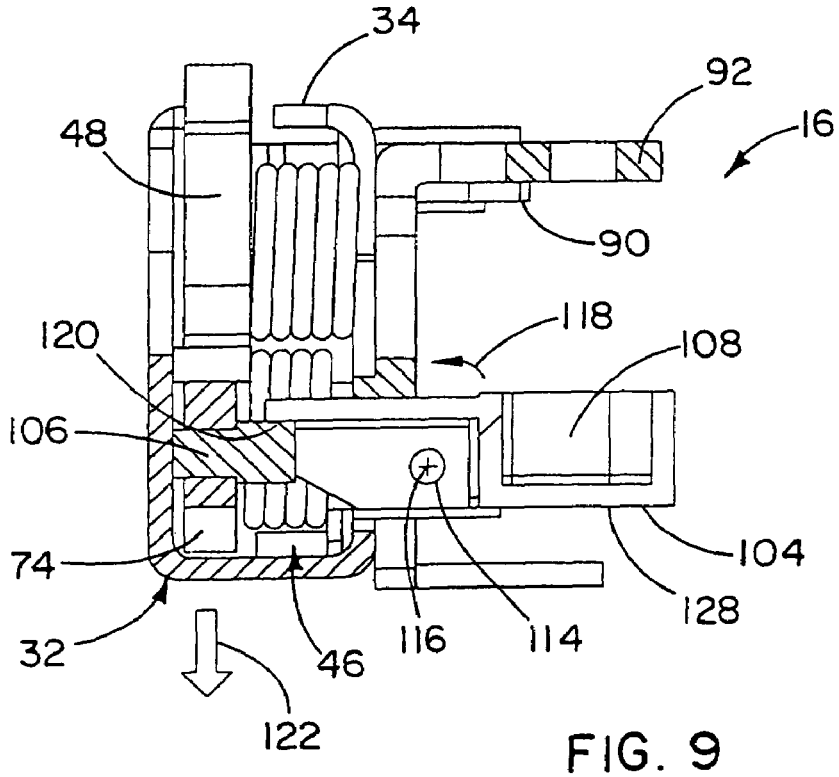
FIG. 9 is a bottom view of the latching assembly in FIGS. 5–8 with the housing partially broken away.

Cooperating rotors 48, 50 are journalled for rotation relative to the axles 40, 42, respectively, for pivoting movement around parallel axes 52, 54. The rotors 48, 50 are pivotable around their respective axes 52, 54 between a latched position, as shown in FIGS. 5 and 8 and in solid lines in FIG. 6, and a release position, as shown in phantom lines in FIG. 6. Through torsion springs 56, 58, the rotors 48, 50 are biased around their respective axes 52, 54 towards their release positions.

The rotor 48 has a U-shaped portion remote from the axis 52 with spaced legs 60, 62 between which a U-shaped edge 64 extends so as to define a receptacle. The rotor 50 has corresponding legs 60', 62' between which a U-shaped edge 64' extends.

Figure 6:
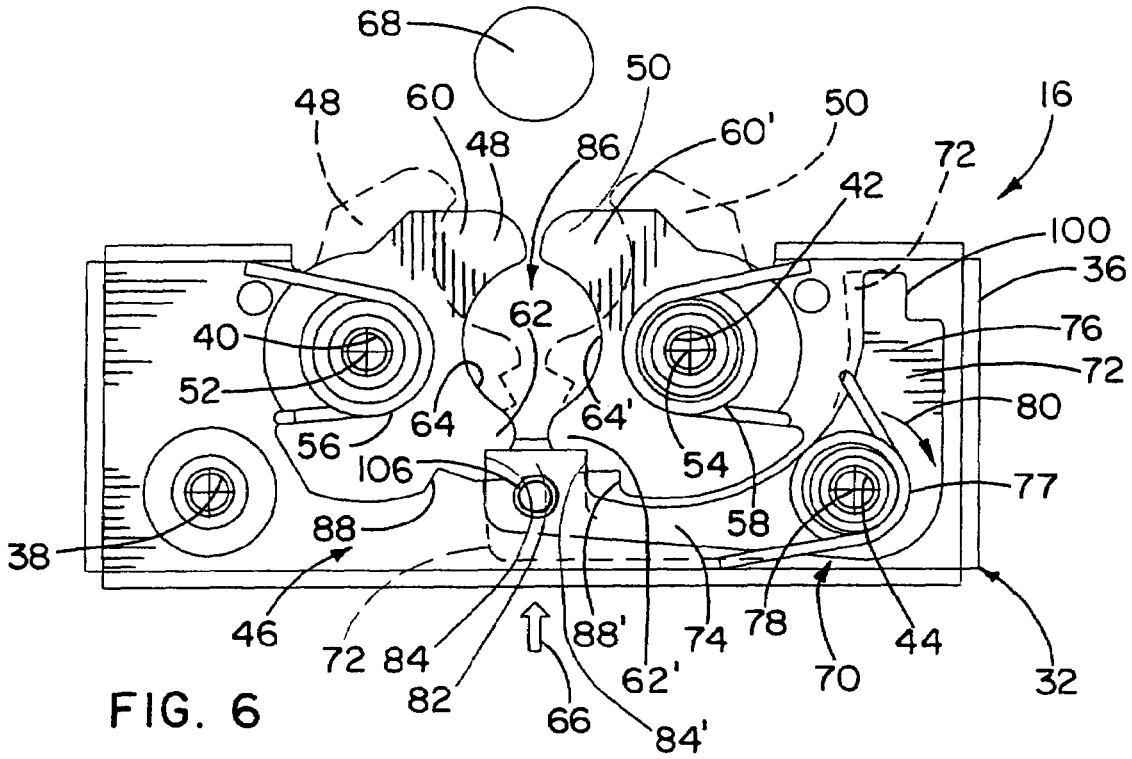
FIG. 6 is a view of the latching assembly from the side opposite that in FIG. 5, with a part of a housing removed to expose the operating components of the latching assembly, including cooperating rotors which are shown in relationship to a strike element on the strike assembly of FIG. 1.
Figure 7:
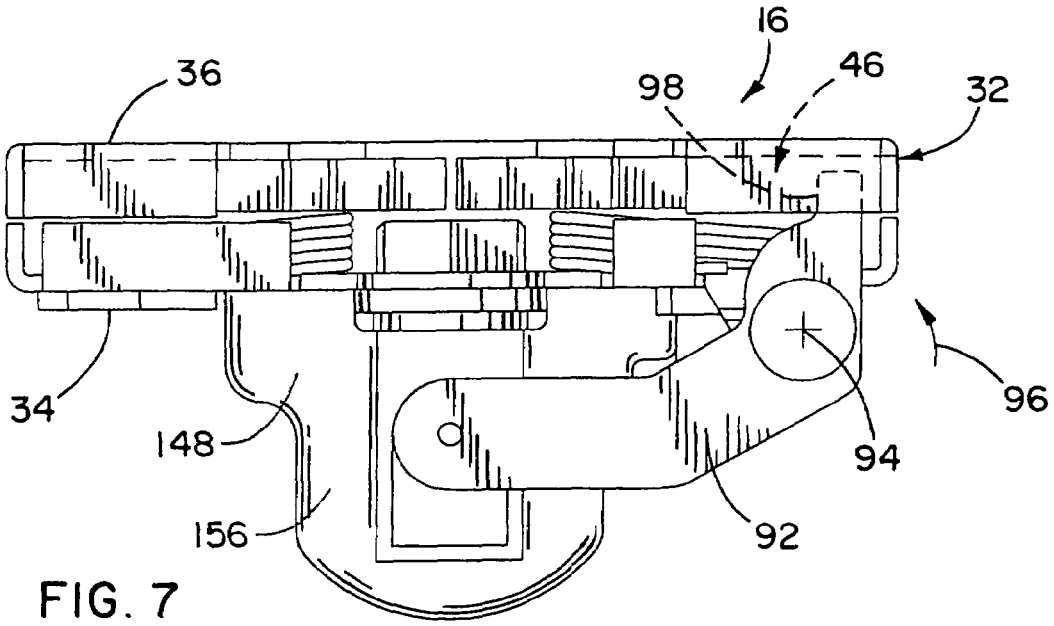
FIG. 7 is a rear elevation view of the latching assembly in FIGS. 5 and 6.

With the rotors 48, 50 in their release positions, advancement of the movable closure element 12, upon which the latching assembly 16 is mounted, in the direction of the arrow 66 in FIG. 6 towards the one predetermined position in which it is to be releasably maintained, causes a strike element 68 on the strike assembly 18 to bear upon the rotor legs 62, 62'. Continued movement of the movable closure element 12 in the direction of the arrow 66 causes the strike element 68 to progressively urge the rotors 48, 50 in movement around their axes 52, 54 into the latched positions, therefor.

The latched positions for the rotors 48, 50 are maintained by a catch assembly at 70, including an L-shaped catch element 72 with transverse catch and operating arms 74, 76, respectively. The catch element 72 is guided in pivoting movement around the axle 44 and is normally biased by a torsion spring 77 around an axis 78, defined by the axle 44, in the direction of the arrow 80 into a first position, as shown in FIG. 6.

Once the strike element 68 urges the rotors 48, 50 into their latched positions, a head 82 on the catch arm 74 is biased to reside captively between stop surfaces 84, 84' on the rotors 48, 50, respectively, with the catch element 72 in the first position. This represents a first state for the latching assembly 16, wherein the rotors 48, 50 are maintained in the latched position therefor and the strike element 68 resides captively within a receptacle 86 bounded cooperatively by the U-shaped edges 64, 64' on the rotors 48, 50. By pivoting the catch element 72 around the axle 44 in a direction opposite to that indicated by the arrow 80, the catch element 72 is pivoted to the phantom line position in FIG. 6, whereupon the head 82 clears out of the path of the stop surfaces 84, 84', allowing the torsion springs 56, 58 to drive the rotors 48, 50 back into their release positions, whereupon the latching assembly 16 assumes a second state.

The latching assembly 16 is designed to have a third state wherein the head 82 on the catch element 72 abuts separate stop surfaces 88, 88' on the rotors 48, 50, to maintain the rotors in a "secondary" latched position between the release position and the aforementioned latched position, which is a "primary" latched position.

The first housing part 34 has a projecting tab 90 which defines a support for a L-shaped operating arm 92. The operating arm 92 is mounted to the tab 94 for pivoting movement around an axis 94 that is generally orthogonal to the axis 78 about which the catch arm 74 pivots between its first and second positions. By pivoting the operating arm 92 around the axis 94, in the direction of the arrow 96, an edge 98 on the operating arm 92 is driven against an edge 100 on the operating arm 76 to thereby pivot the catch element 72 from its first position into its second position against the bias of the torsion spring 77. The operating arm 92 can be repositioned by any type of means known to those in this art, as shown schematically in FIG. 4, which means 102 may be a mechanical or an electromechanical structure.

The primary actuating structure for the catch element 72 includes a pivotable trip actuator 104. The trip actuator 104 cooperates with a cantilevered post 106 projecting from the catch arm 74. The trip actuator 104 has a body 108 that is pivotably mounted between a pair of spaced tabs 110, 112, projecting from the first housing part 34. A mounting pin 114 projects through the tabs 110, 112 and the body 102 so that the body 108 is pivotable relative to the tabs 110, 112, around an axis 116.

With the latching assembly 16 in the first state therefor, pivoting movement of the trip actuator 104, in the direction of the arrow 118 around the axis 116, causes an edge 120 on the trip actuator 104 to bear against, and drive, the post 106 in the direction of the arrow 122, which effects repositioning of the catch element 72 from the first position, into the second position therefor, as previously described.

Figure 10:
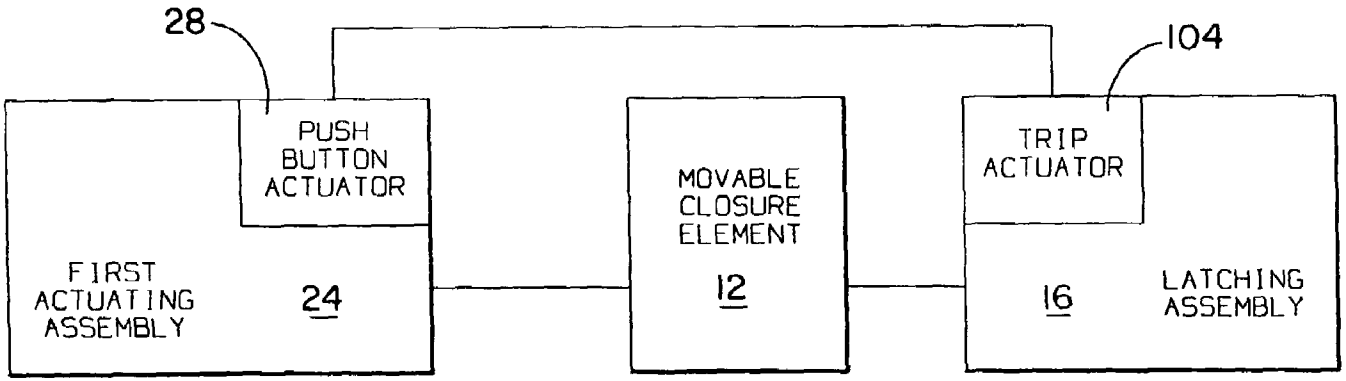
FIG. 10 is a schematic representation of the first actuating assembly in operative relationship with the latching assembly and operably mounted upon a movable closure element.

As seen in FIGS. 4 and 10, the first actuating assembly 24 can be assembled for operation as a self-contained module through fasteners 124 to reside on one side of the movable closure element 12 by simply translating the module along the line L to against the closure element one side and securing the module thereto through fasteners. Through this translational movement alone, the first actuating assembly and remainder of the lock system components become operably related without any parts thereof being secured together, as through a separate fastener, or fasteners, acting between the blocking assembly 22 and first actuating assembly. The latching assembly 16 can be mounted to the movable closure element 12 through fasteners 126. With the first actuating assembly 24 and latching assembly 16 in operative relationship, the free end 30 of the push button actuator 28 aligns with the surface 128 (FIG. 9) of the trip actuator 104. By moving the push button actuator 28 from its normal position into its actuated position, the free end 30 of the push button actuator 28 is caused to move in an actuating path towards and against the trip actuator surface 128. As the push button actuator 28 moves fully through its actuating path through its full anticipated operating range, the trip actuator 104 is repositioned to thereby cause the catch element 74 to change from its first position into its second position, thereby changing the latching assembly 16 from its first state into its second state.

In the embodiment shown in FIGS. 4 and 10, the push button actuator 28 is mounted for guided movement between its normal and actuated positions by a housing 130, in this case defining a graspable handle at 132. By grasping the handle 132, the user's thumb is situated to conveniently access the push button actuator 28 to allow depression thereof to effect repositioning of the push button actuator 28 from the normal position into the actuated position.

Figure 11:
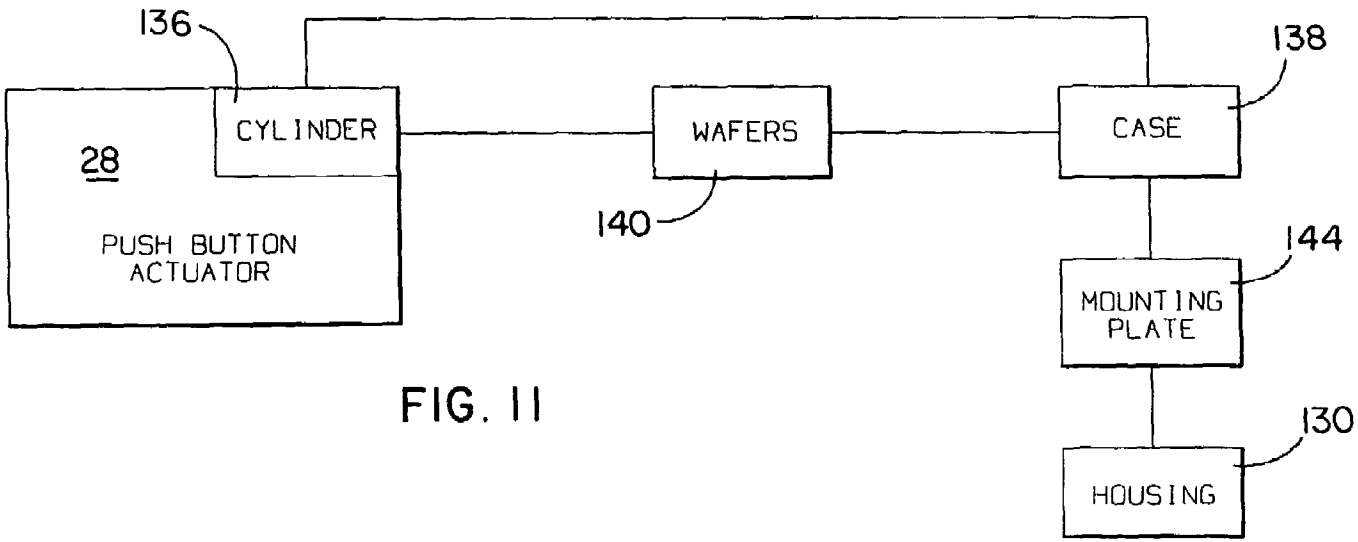
FIG. 11 is a schematic representation of the first actuating assembly.

The precise structure through which the push button actuator 28 is operably mounted to the housing 130 is not critical to the present invention. As shown in FIG. 4 and schematically in FIG. 11, the push button actuator 28 has an associated cylinder 136 that is mounted within a case 138. The case 138 is keyed against pivoting movement about the line L relative to the housing 130 but is translatable with the push button actuator 28 as the push button actuator moves between its normal and actuated positions. The cylinder 136 is guided for pivoting movement within the case 138. Conventional wafers 140 which are strategically repositioned by a key 141 as it is introduced into a slot 142 in a conventional manner. The case 138 is mounted in conventional fashion to the housing 130 through a mounting plate 144.

Figures 12, 13:
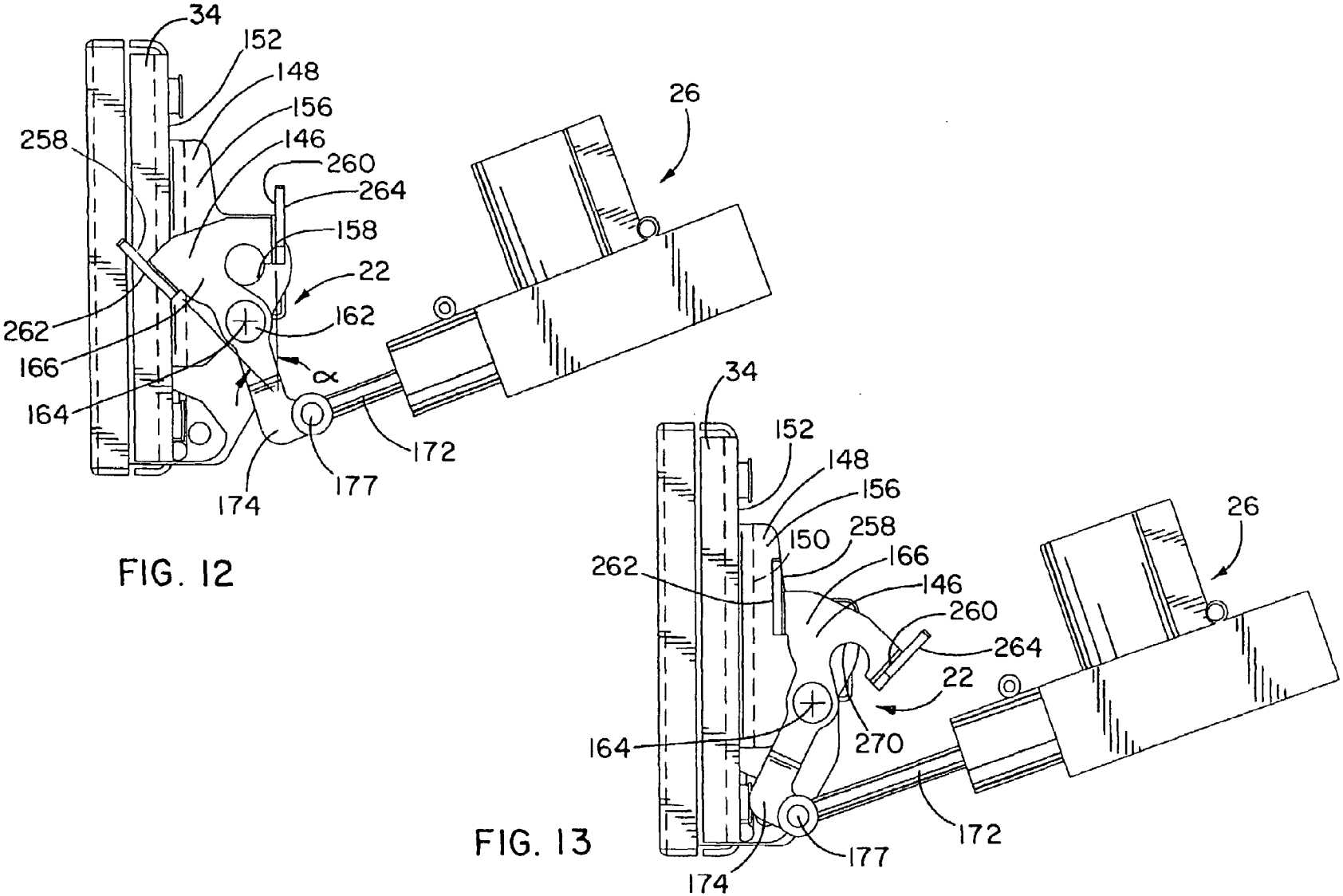
FIG. 12 is an elevation view of the second actuating assembly operatively associated with the blocking assembly and the latching assembly and with the second actuating assembly operated to place the blocking assembly in a state corresponding to the unlocked state for the lock system.
FIG. 13 is a view as in FIG. 12 with the blocking assembly in a state representing the unlocked state for the lock system.

According to the invention, the blocking assembly 22 is mounted independently of the first actuating assembly 24 and utilized to selectively block movement of the free end 30 of the push button actuator 28 in its actuating path in a manner that would allow repositioning of the catch element 72 from its first position into its second position. More specifically, as shown in FIGS. 4 and 12–15, the blocking assembly 22 includes a plate 146 that is movable between a first/one position, as shown in FIG. 12, and a second/another position, as shown in FIG. 13. With the plate 146 in the first position, the blocking assembly 22 is in a first state, wherein the lock system 10 is in an unlocked state. With the lock system 10 in the unlocked state, the push button actuator 28 can be moved in the actuating path along the line L (FIG. 4) from its normal position into its actuated position to change the state of the latching assembly 16. With the plate 16 in the second position, the push button actuator 28 is blocked from moving through its actuating path to the extent required to cooperate with the latching assembly 16 so as to change the state thereof.

The blocking assembly 22 includes an L-shaped mounting bracket 148 (see also FIG. 8) with a mounting wall 150 that is facially abutted to a flat surface 152 of the first housing part 34 and maintained thereagainst by the axles 40, 42. An opening 154 is provided through the mounting wall 150 to accommodate the trip actuator 104. The mounting bracket 148 is bent to form a flange 156 which is orthogonal to the mounting wall 150. The flange 156 has a through opening 158 through which the free end 30 of the push button actuator 28 passes as the push button actuator 28 is changed from the normal position into the actuated position therefor. The through opening 158 allows the free end 30 of the push button actuator 28 to engage and reposition the trip actuator 104.

The plate 146 on the blocking assembly 22 is mounted to one side 160 of the flange 146 through a pin 162, whereby the plate 146 is allowed to pivot around an axis 164 between the aforementioned first and second positions, shown respectively in FIGS. 12 and 13. With the plate 146 in the second position of FIG. 13, a wall 166 on the plate 146 is moved so as to block the flange opening 158 and thereby the actuating path for the free end 30 of the push button actuator 28. With the blocking assembly 22 in this state, the lock system 10 is in a locked state and incapable of being operated by translation of the push button actuator 28.

Figure 16:
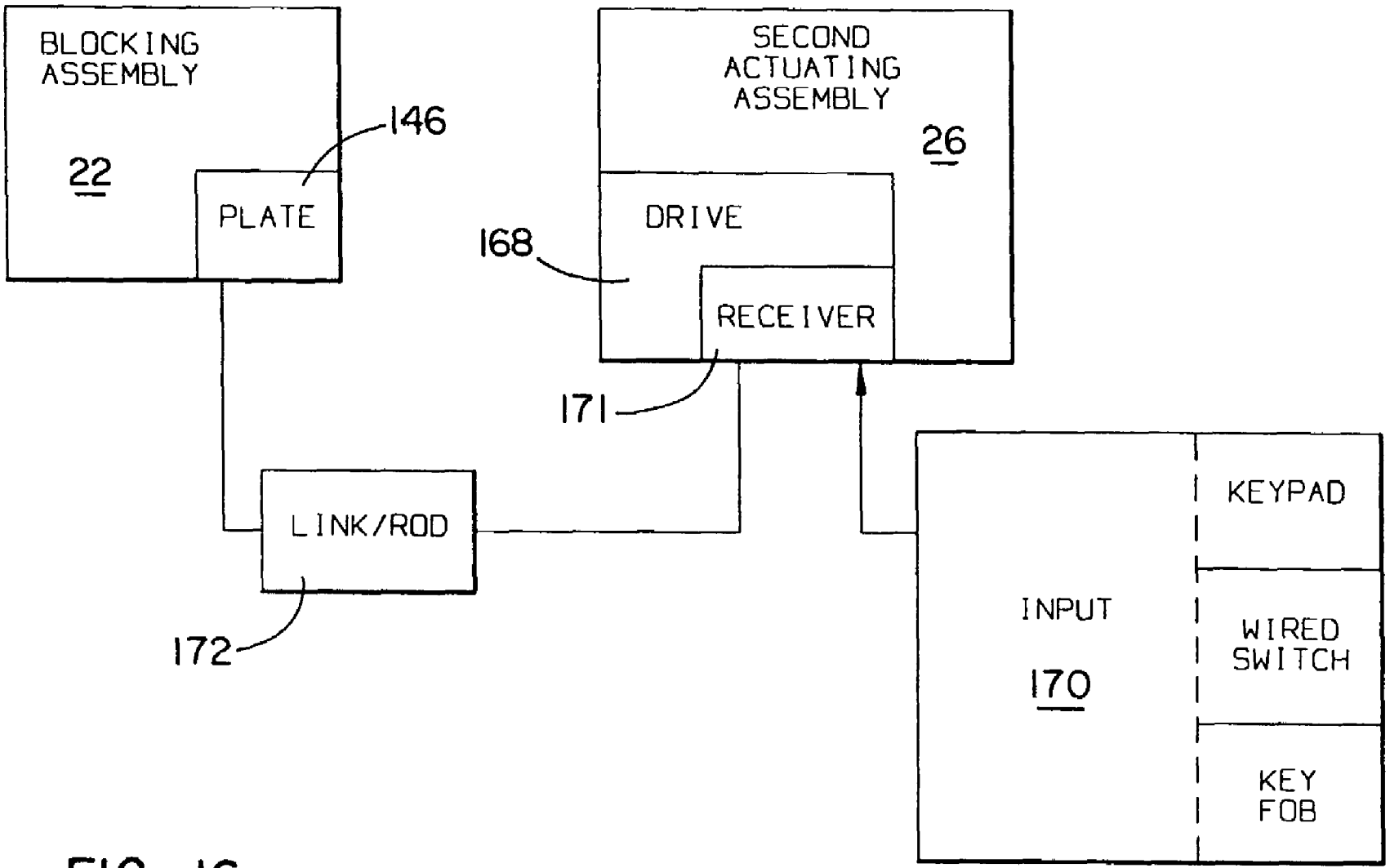
FIG. 16 is a schematic representation of the second actuating assembly operatively engaged with the blocking assembly.

The blocking assembly 22 is changeable between its first and second states by either the first actuating assembly 24 or the second actuating assembly 26. As shown additionally in FIG. 16, the second actuating assembly 26 may incorporate an actuator that may be a "power lock actuator" of the type currently offered by the assignee herein. The power lock actuator may be any type of actuator with a push/pull capability with a drive 168 which is operable in response to a signal from an input 170. The input 170 may be wired to the drive 168 or may communicate therewith wirelessly, as through an RF signal. As examples, the input 170 may be a keypad that communicates through wires or wirelessly to a receiver 171 associated with the drive 168. Alternatively, the transmitter may be integrated into a key fob. Exemplary communication systems, offered by the assignee herein and identified commercially as its "e-ASK System", are shown in published U.S. patent application Ser. Nos. 2004/0027238A1 and 2004/0027237A1, the disclosures of which are incorporated by reference herein. The drive 168 is operatively connected to the plate 146 through a link/rod 172. More specifically, the link/rod 172 is connectable to an offset end 174 on the plate 146. The end 174 has a through opening 176 to accommodate a pin 177 to make a pivot connection between the link/rod 172 and the offset end 174 of the plate 146 . The second actuating assembly 26 may be suitably attached to the support 14. As previously mentioned, the second actuating assembly 26 is not limited to power actuation. The second actuating assembly 26 may be manually operable and may utilize an entirely mechanical structure or an electromechanical structure.

Figure 30:
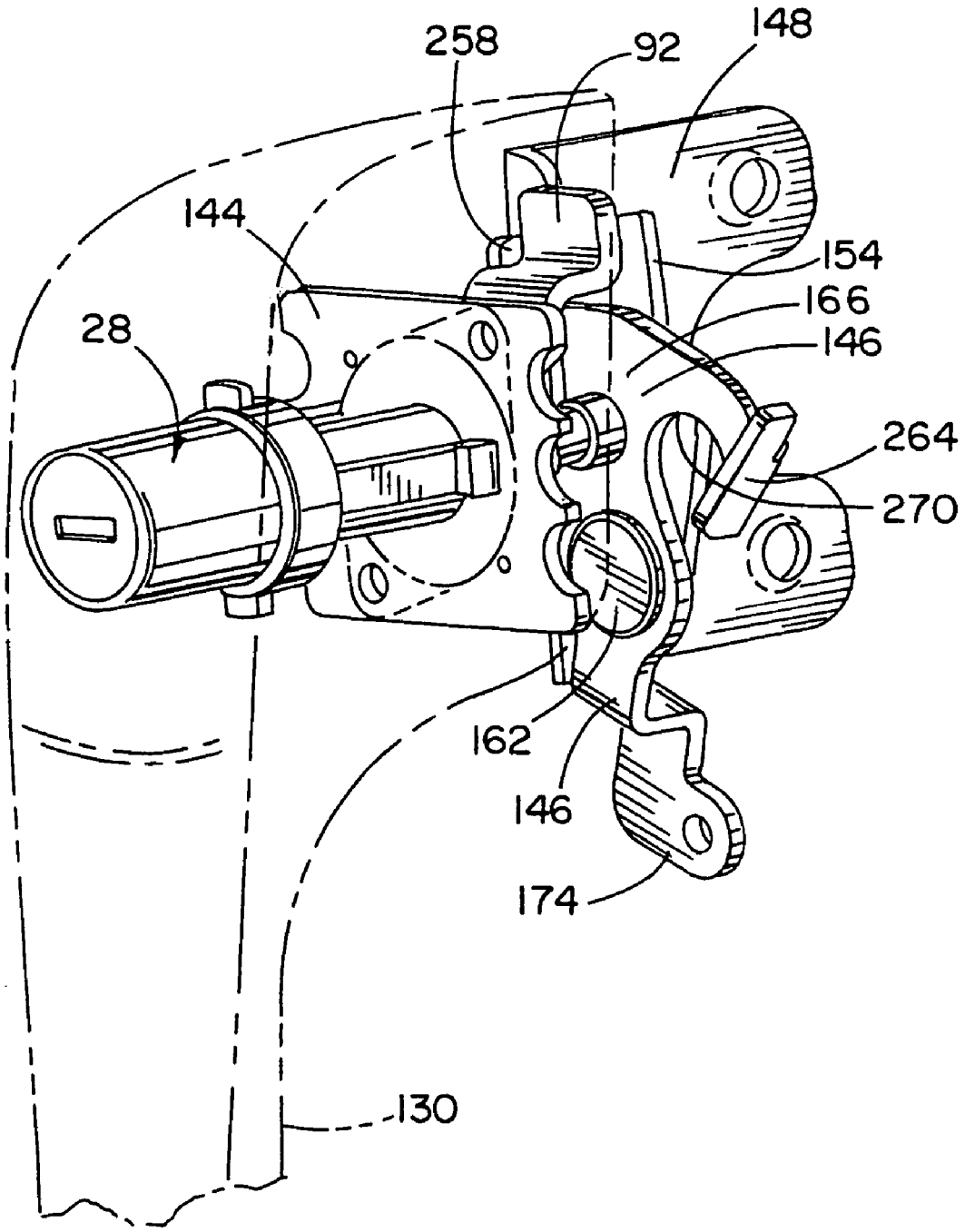
FIG. 30 is a perspective view of the first actuating assembly and blocking assembly in the state of FIG. 27, shown in relationship to a part of the housing with a graspable handle.

The first actuating assembly 24 is likewise operable to change the state of the blocking assembly 22. Details of the first actuating assembly 24 and its interaction with the blocking assembly 22 will now be described with respect to primarily FIGS. 12–30. For purposes of clarity, in FIGS. 14-30, the push button actuator 28 is shown in relationship to the mounting plate 144 without the associated housing 130 to which the mounting plate 144 is fixed. The mounting plate 144 is intended to be fixed to the housing 130, as shown in FIG. 4 and in phantom lines in FIG. 30, to maintain the desired, operative position of the push button actuator 28 on the first actuating assembly 24.

Figure 17:
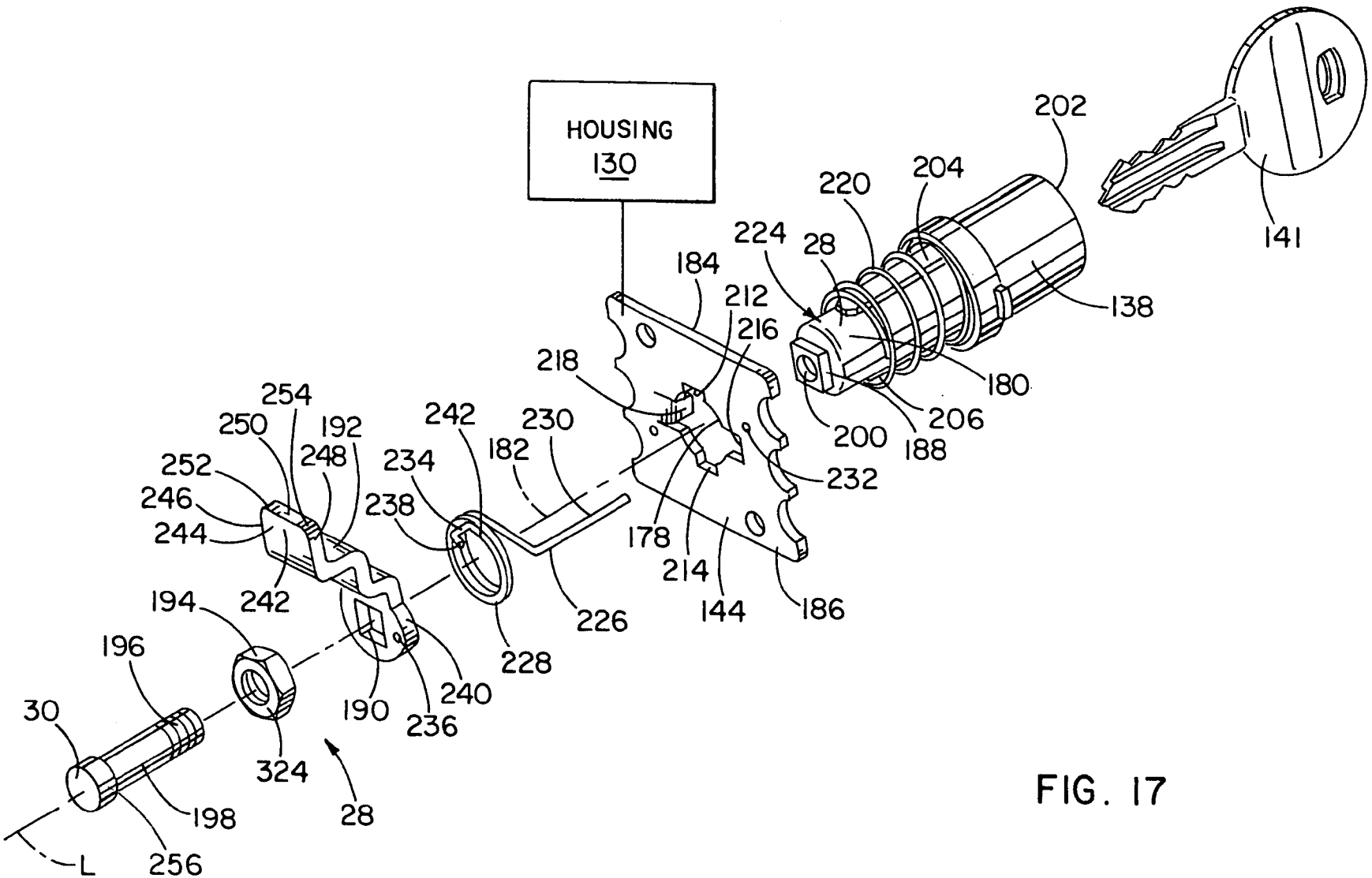
FIG. 17 is an exploded perspective view of the push button actuator.

As seen most clearly in FIG. 17, the plate 144 has a through opening 178 to guide movement of a cylindrical body 180 on the push button actuator 28 along the line L, in the actuating path therefor. The line L coincides with the central axis 182 of the body 180. With the body 180 directed from one side 184 of the mounting plate 144, through the mounting plate 180 to be exposed at the other side 186 thereof, a polygonally-shaped end 188 on the cylindrical body 180 can be directed into a correspondingly configured opening 190 on a cam element 192. While the end 188 and opening 190 are shown to be substantially square, any cooperating complementary shapes that key the body 180 and cam element 192 against relative rotational around the axis 182 are contemplated by the invention.

The cam element 192 is maintained on the body 180 by a threaded nut 194 which mates with the threaded end 196 of a post 198. The post end 196 is threadably engaged within a blind bore 200 at the end of the body 180. By controlling the degree of penetration of the post 198 into the body 180, the effective length of the push button actuator 28, between the free end 30, and the end 202 of the push button actuator 28 axially opposite to the free end 30, can be varied. This allows necessary relational adjustments to be made between the push button actuator 28 and latching assembly 16.

The body 180 has diametrically opposite, radially projecting, elongate, axially extending ribs 204, 206 which are received in correspondingly configured extensions 212, 214, 216 218 to allow the body 180 to be guided along the line L through the mounting plate 144 while limiting relative pivoting movement of the body 180 and plate 144 around the axis 182. By providing the extensions at regular, 90° intervals, the body 180 is selectively insertable through the opening 178 in potentially four, different angular orientations, with each successive change in angular orientation angularly shifting the key slot 142 by 90°. As a practical matter, only two different orientations, 90° offset from each other, would be used.

Figure 18:
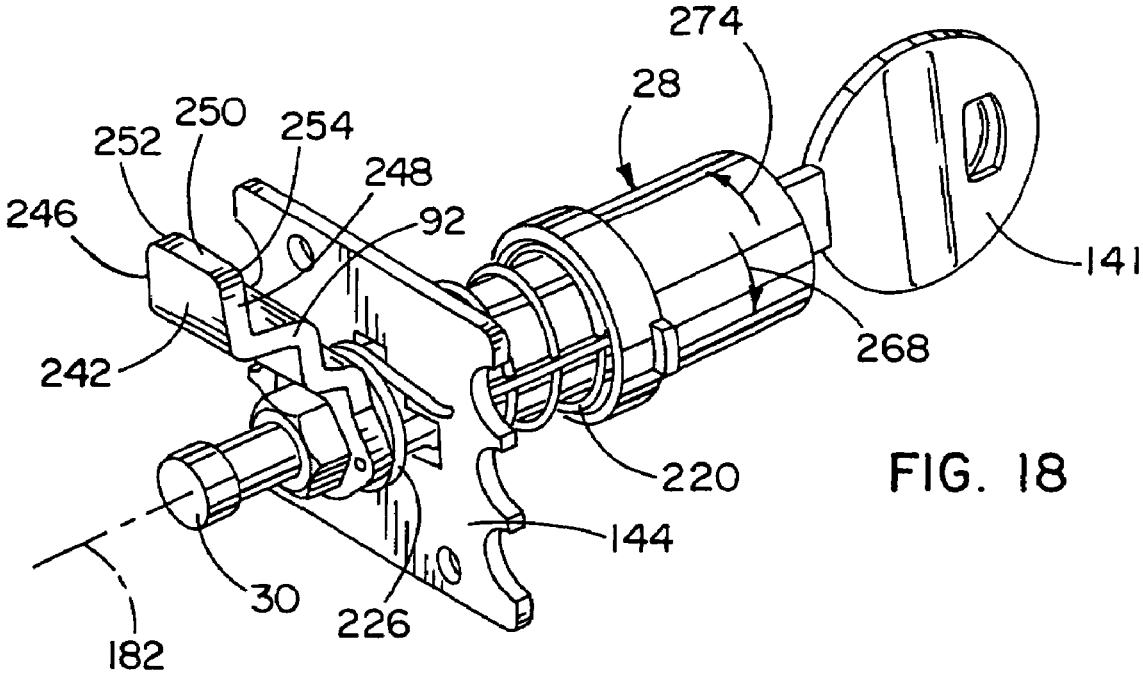
FIG. 18 is an enlarged view as in FIG. 17, with the first actuating assembly in an assembled state and with the push button actuator in a retracted, normal state and pivoted to a resting position.
Figure 19:
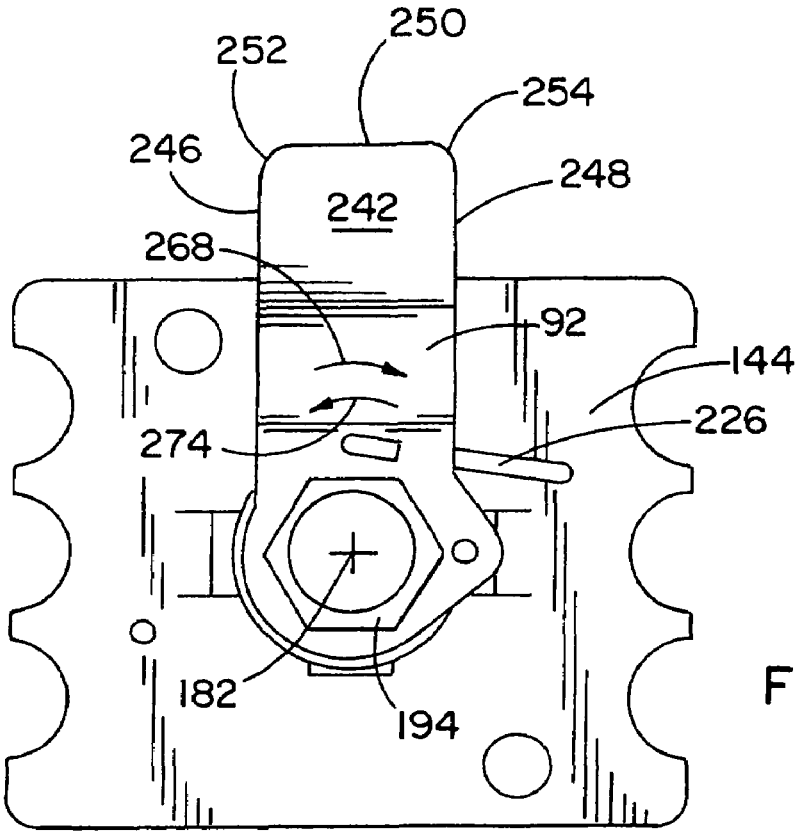
FIG. 19 is an end elevation view of the push button actuator in the state of FIG. 18.
Figure 20:
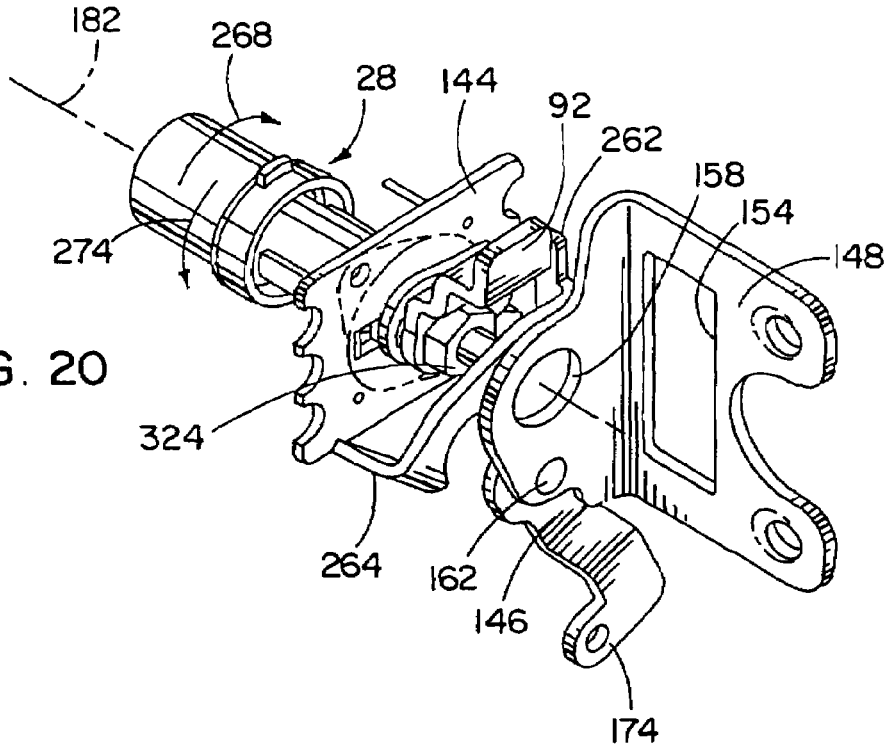
FIG. 20 is a view as in FIG. 14 wherein the blocking assembly is in the FIG. 13 state.
Figure 21:
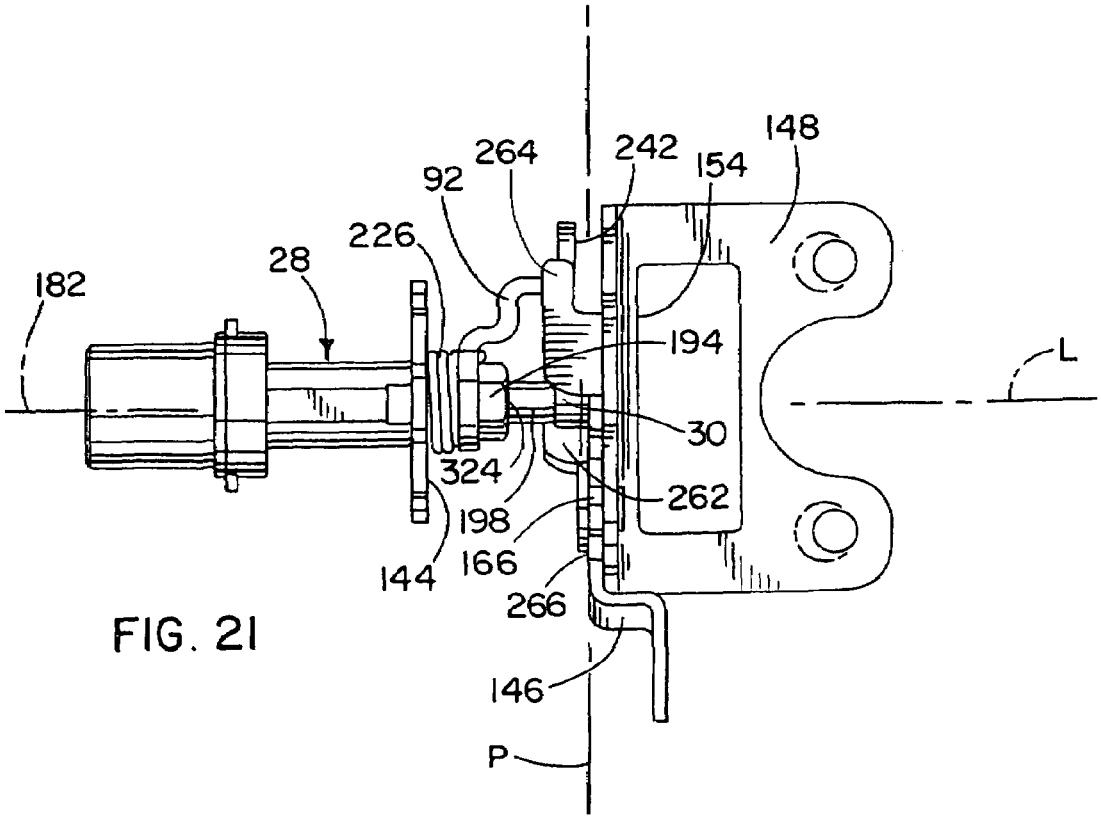
FIG. 21 is a side elevation view of the first actuating assembly and blocking assembly in the FIG. 20 state.
Figure 26:
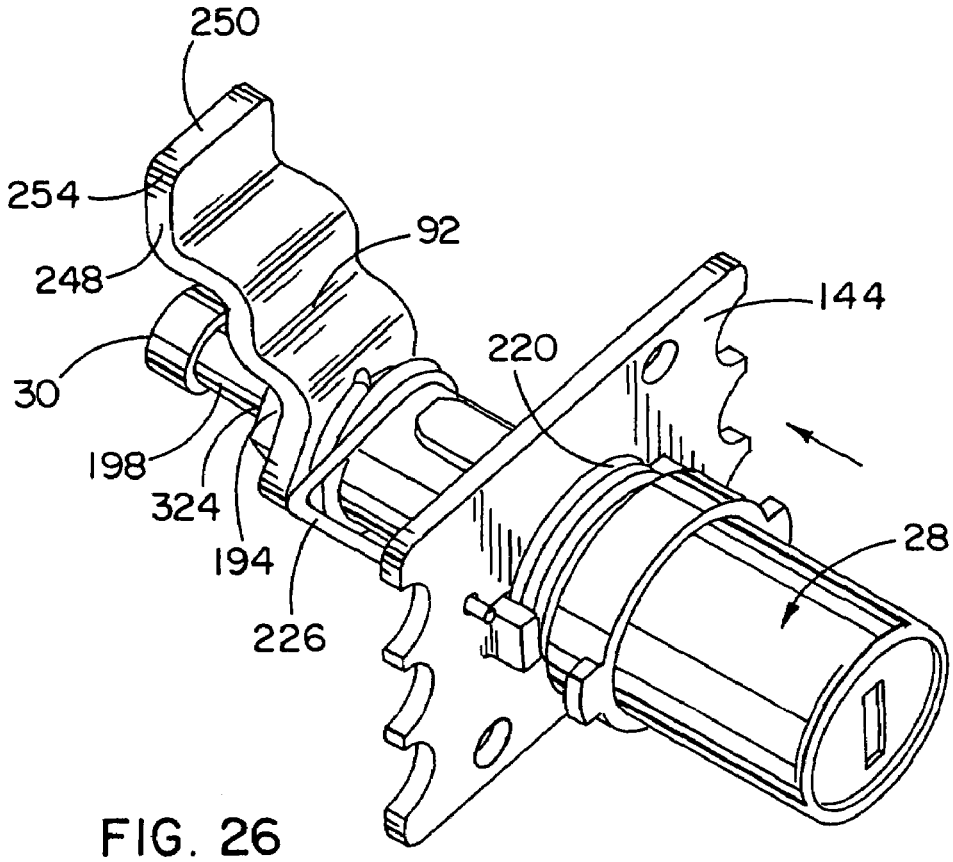
FIG. 26 is a perspective view of the first actuating assembly pivoted to the resting position and depressed to an actuated position.
Figure 28:
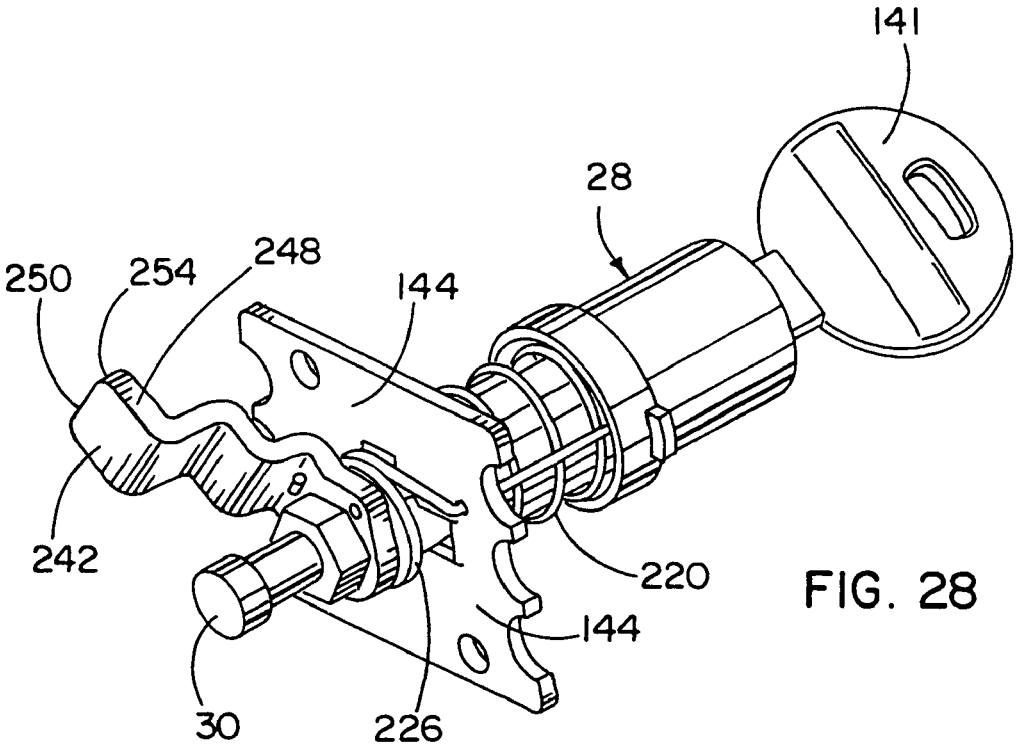
FIG. 28 is a perspective view of the first actuating assembly with the push button actuator in the state show in FIG. 27.
Figure 29:
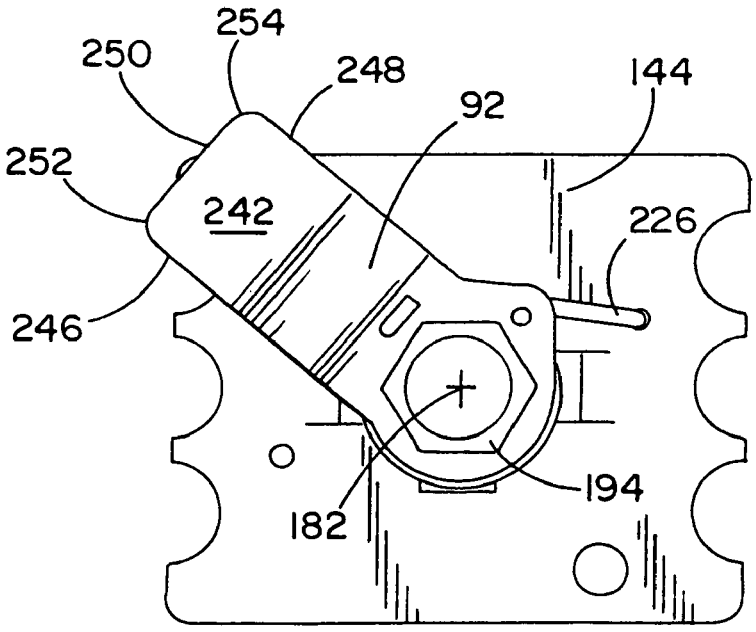
FIG. 29 is an end elevation view of the push button actuator in the FIG. 28 state.

A coiled, compression spring 220 surrounds the body 180 and acts between the case 138 and the mounting plate 144 to normally bias the push button actuator 28 towards the normal/retracted position, as shown in FIGS. FIGS. 18 and 21. The coil spring 220 is axially compressed with the push button actuator 26 in the actuated position therefor, as seen in FIG. 26. The ribs 204, 206 are axially dimensioned so that there is a portion of the body at 224, which has no ribs, and that axially aligns with the mounting plate 144 to allow the push button actuator 28 to pivot around the axis 182 without any interference between the ribs 204, 206 and the mounting plate 144.

A positioning spring 226 has a coiled portion 228 that surrounds the portion 224 of the body 180. One end 230 of the spring 226 projects axially through an opening 232 through the mounting plate 144 into axially overlapping relationship with the body 180. The opposite end 234 projects through an opening 236 in the cam element 192 and has an offset portion 238. A mounting wall 240 on the cam element 192 is captively maintained between the offset portion 238 and the adjacent spring coil 242. With this arrangement, the positioning spring 226 maintains the push button actuator 28 in a consistent "resting" position with the push button actuator 28 in the normal position therefor and no torque applied to the push button actuator 28.

The cam element 192 has a cantilevered blade 242 projecting away from the mounting wall 240. The blade 242 has a stepped shape which terminates at a generally squared wall portion 244, with oppositely facing side edge portions 246, 248 which merge with a top edge portion 250 at rounded corners 252, 254.

The entire first actuating assembly 24, including the housing 130, can be operatively assembled relative to the blocking assembly 22 as a self-contained module by translating the first actuating assembly module towards the plate 146 parallel to the line L. An enlarged head 256 on the push button actuator 28, on which the free end 30 is defined, and the cam element 192, can be translated along the line L into the operative relationship with the blocking assembly 22, wherein the enlarged head 256 and cam element 192 reside between generally flat, facing surfaces 258, 260, respectively on tabs 262, 264, projecting away from the wall 166 of the plate 146. The plate 166 has a surface 266 that resides in a reference plane P (FIG. 21) that is substantially orthogonal to the line L. The surfaces 258, 260 are substantially flat and each reside in a plane orthogonal to the reference plane P. The planes of the surfaces 258, 260 are angled with respect to each other, with an included angle $\alpha$ (FIG. 12) between the surfaces 258, 260 on the order of 50°.

Figure 14:
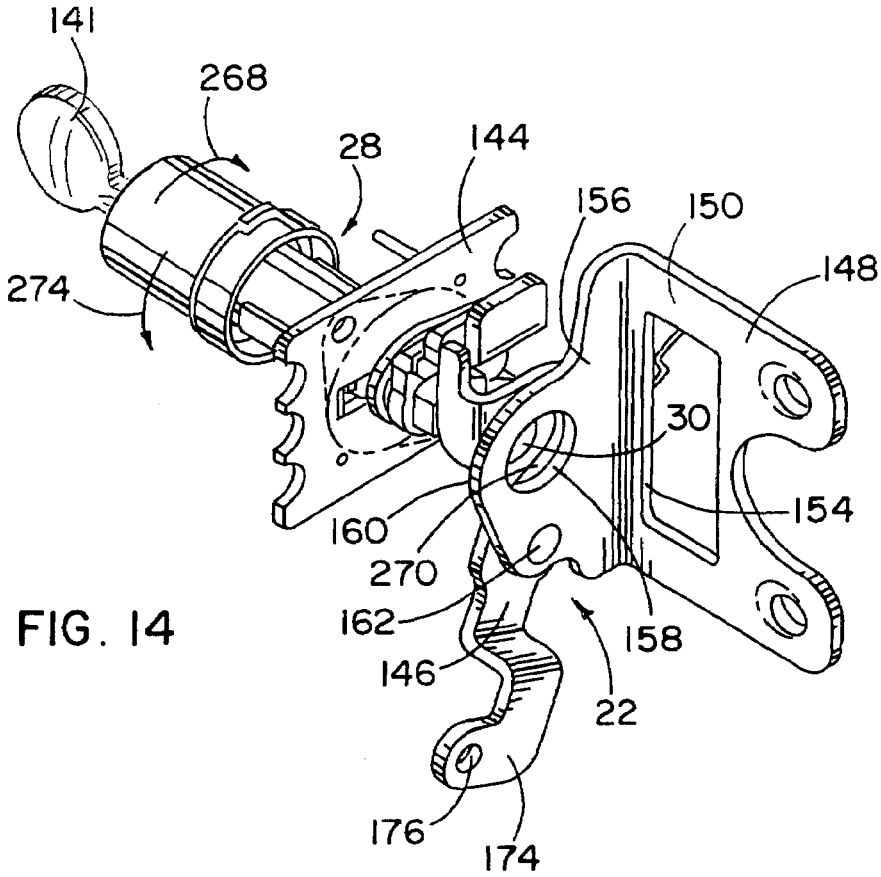
FIG. 14 is a perspective view of the first actuating assembly, absent a housing that is part of the first actuating assembly, and in operative relationship with the blocking assembly of FIGS. 12 and 13 and with the blocking assembly in the state of FIG. 12.
Figure 15:
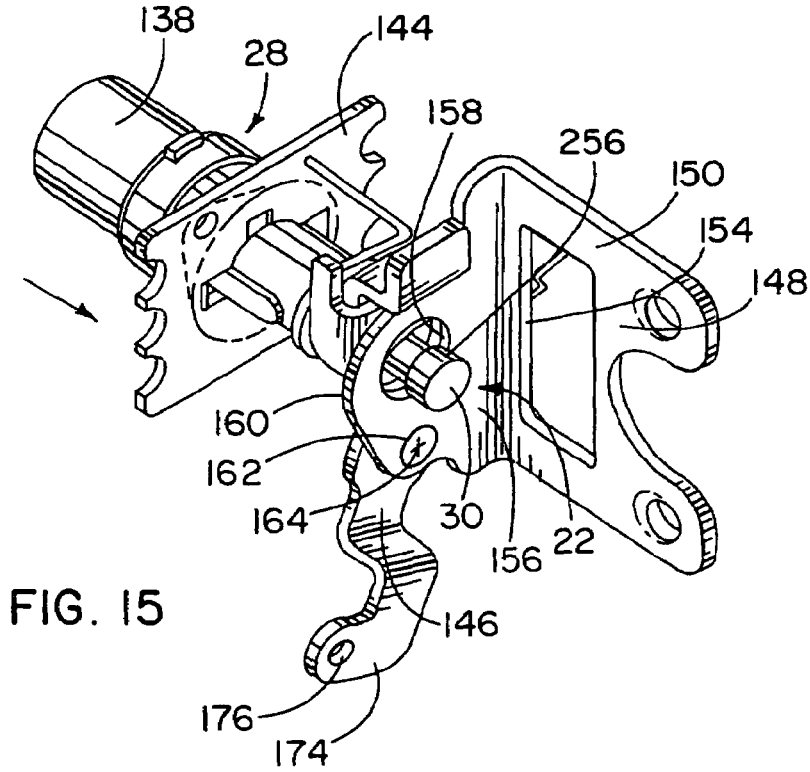
FIG. 15 is a view as in FIG. 14 wherein a push button actuator on the first actuating assembly is repositioned so as to change the state of the latching assembly.
Figure 22:
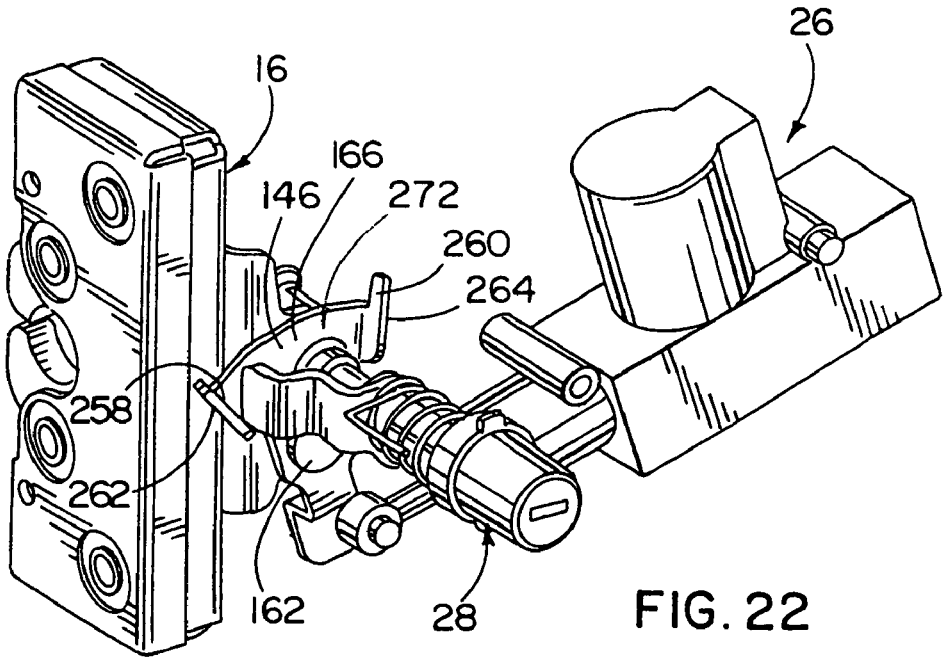
FIG. 22 is a perspective view of the lock system wherein the push button actuator is in a retracted, normal position and pivoted so as to place the blocking assembly in the FIG. 12 state.
Figure 25:
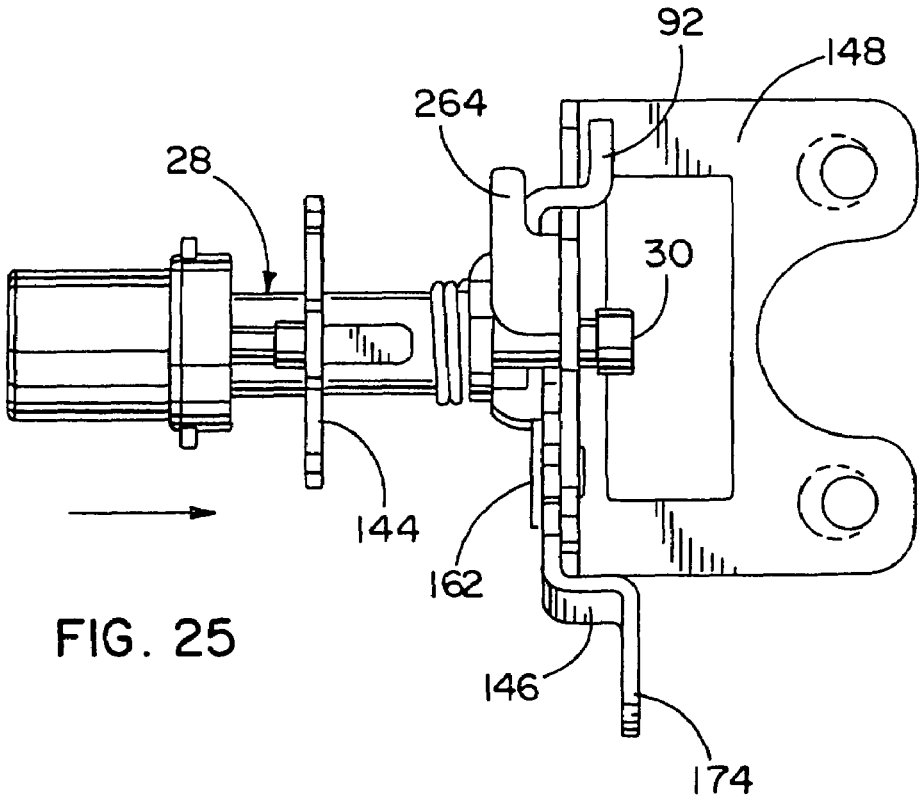
FIG. 25 is a view corresponding to that in FIG. 21 wherein the blocking system is in the FIG. 13 state and the push button actuator is depressed to an actuated position.

With the first actuating assembly 24 and blocking assembly 22 in operative relationship, the state of the push button actuator 28 can be changed to operate the blocking assembly. With the push button actuator 28 in the normal and resting positions, the inserted key 141 can be grasped and turned to pivot the push button actuator 28 in the direction of the arrow 268 around the axis 182 to the state shown in FIGS. 22–24. This causes the side edge portion 248 and rounded corner 254 to sequentially engage the tab surface 258 to pivot the plate 146 into a first position, as seen in FIG. 22. The second actuating assembly 26 is constructed so that it can be overridden to allow the blocking assembly 22 to be placed in this first state through manipulation of the push button actuator 28. By then releasing the turning pressure on the key 141, the positioning spring 226 urges the push button actuator 28 back to its resting position as shown in FIG. 14. The lock system 10 is, through this process, placed in the unlocked state therefor. The push button actuator 28 can then be changed from its normal position into its activated position by translation along the line L, as seen in FIGS. 15, 25 and 26. As this occurs, the enlarged head 256, and the free end 30 thereon, move up to and successively through an opening 270 in the plate 146, and the aforementioned flange opening 158 to thereby change the state of the latching assembly 16. The stepped arrangement of the cam element 192 allows the squared wall portion 244 on the blade 242 to be directed axially into a space 272 between the tabs 262, 264 without interference between the cam element 192 and the plate 146.

Figure 27:
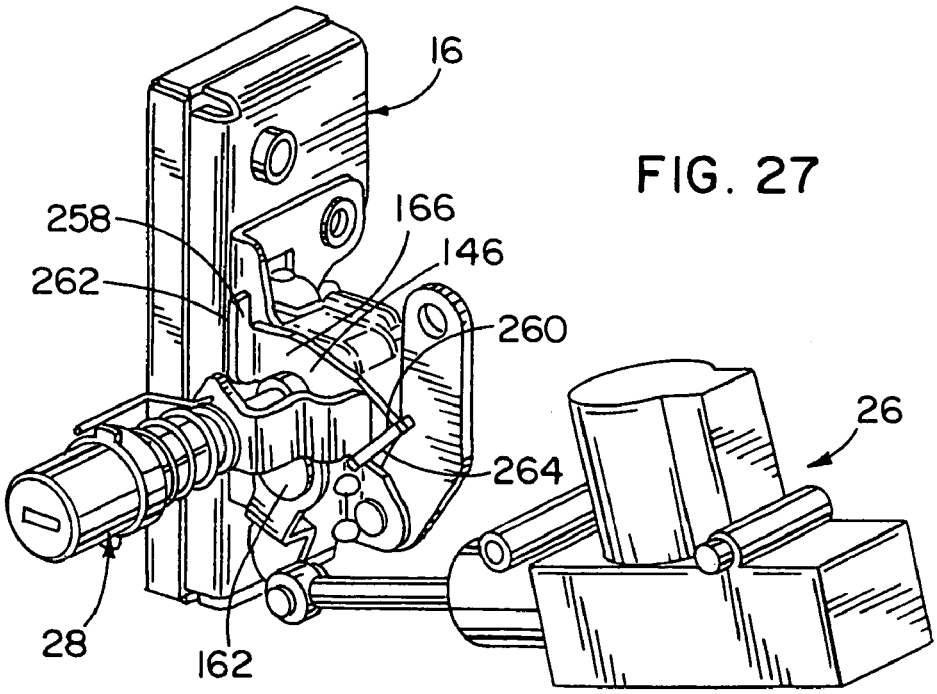
FIG. 27 is a view similar to that in FIG. 22 wherein the push button actuator is pivoted to place the blocking system in the FIG. 13 state.
Figure 23:
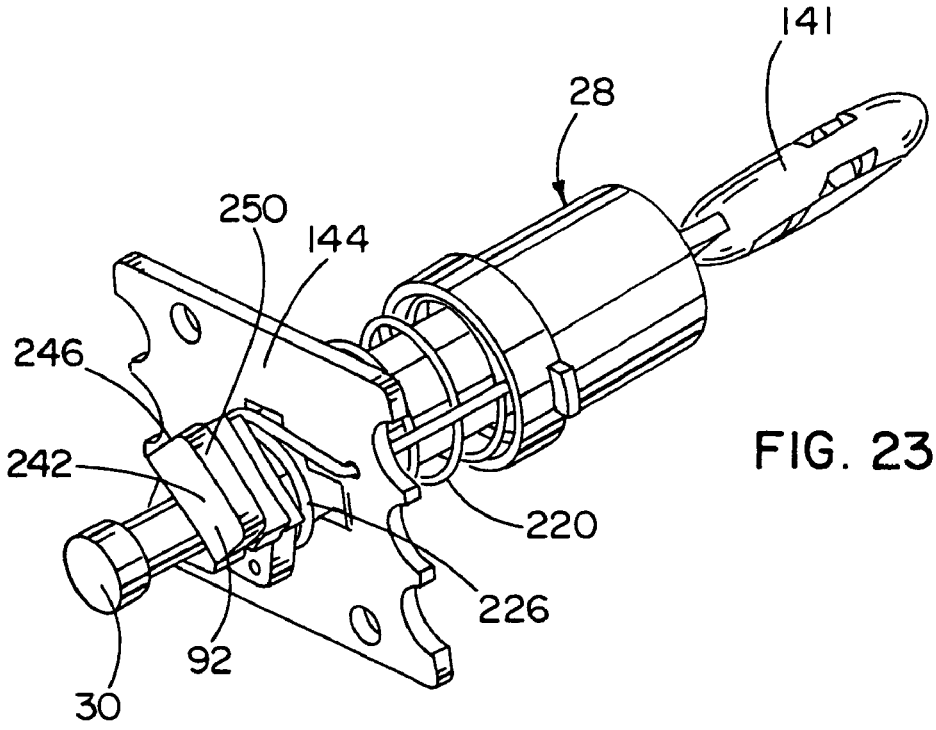
FIG. 23 is a view as in FIG. 18 wherein the push button actuator is in the state shown in FIG. 22.
Figure 24:
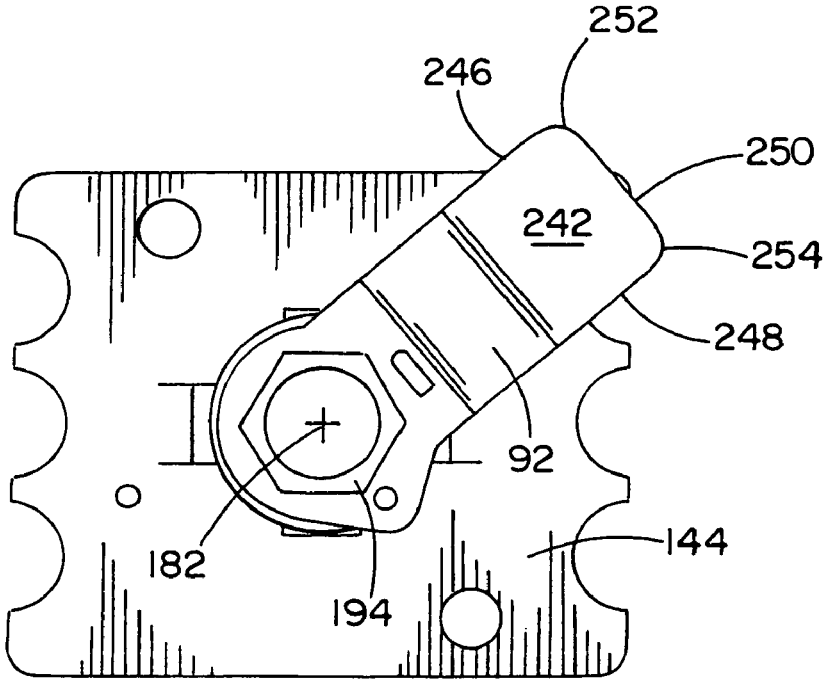
FIG. 24 is an end elevation view of the push button actuator in the FIG. 23 state.

With the push button actuator 28 in the resting and normal positions of FIGS. 14 and 18–21, the push button actuator 28 can be pivoted through the inserted key 141 in the direction of the arrow 274 around the axis 182 to bear the side edge portion 246 and rounded corner 252 sequentially against the surface 260 on the tab 264 to pivot the plate 146 into the second position of FIG. 27. The push button actuator 28, 50 moved, resides in the state shown in FIGS. 28 and 29. This causes the wall 166 on the plate 146 to block the flange opening 158, thereby prohibiting the push button actuator 28 to move through its full stroke in the actuating path to change the state of the latching assembly 16. This represents the locked state for the lock system 10.

The first actuating assembly 24, as described above, has potentially four states. In the first state, the push button actuator 28 is in the normal and resting positions. In the second state the push button actuator 28 is in the actuated position. In a third state, the push button actuator 28 is retracted to the normal position and pivoted in one direction around the axis to a first position so as to place the plate 146 in its first position. In the fourth state, the push button actuator 28 is pivoted to a second position so as to place the plate 146 in its second position.

With the lock system 10 in the unlocked state, the push button operator 28 can be depressed from the normal position into the actuated position to operate the latching assembly 18. The key 141 is removable with the first actuating assembly 24 in this first state.

The cylinder 136, case 138, and wafers 140 cooperate in such a manner that with the key 141 inserted and the first actuating assembly 24 in each of the third and fourth states, the key 141 cannot be withdrawn. The user must allow the push button actuator 28 to be returned to the resting position by the positioning spring 226 before the key 141 can be removed.

With the lock system 10, as described above, while the blocking assembly 22 is movable through the first actuating assembly 24 the blocking assembly 22 is also operable by movement independently of the first actuating assembly module. Whereas, in the prior art, the push button actuator 28 would be locked relative to the housing 130 to place the lock system 10 in the locked state, with the inventive structure, the locking of the overall system 10 is effected through the blocking assembly 22 that is capable of operation independently of the first actuating assembly 24, thereby permitting use of a second actuating assembly 26 to change the lock system 10 between locked and unlocked states. This permits the second actuating assembly 26 to be operable, as through wireless transmission of an operating signal using a key fob. As noted above, an electronic key pad could be utilized to effect actuation of the second actuating assembly 26. Other configurations for the second actuating assembly are contemplated which can be used to lock and unlock the system 10 independently of the first actuating assembly 24.

At the same time, the system 10 has the ability to override the second actuating assembly 26 to change the state of the system 10, in this case through the key operated push button actuator 28 on the first actuating assembly 24.

Figure 31:
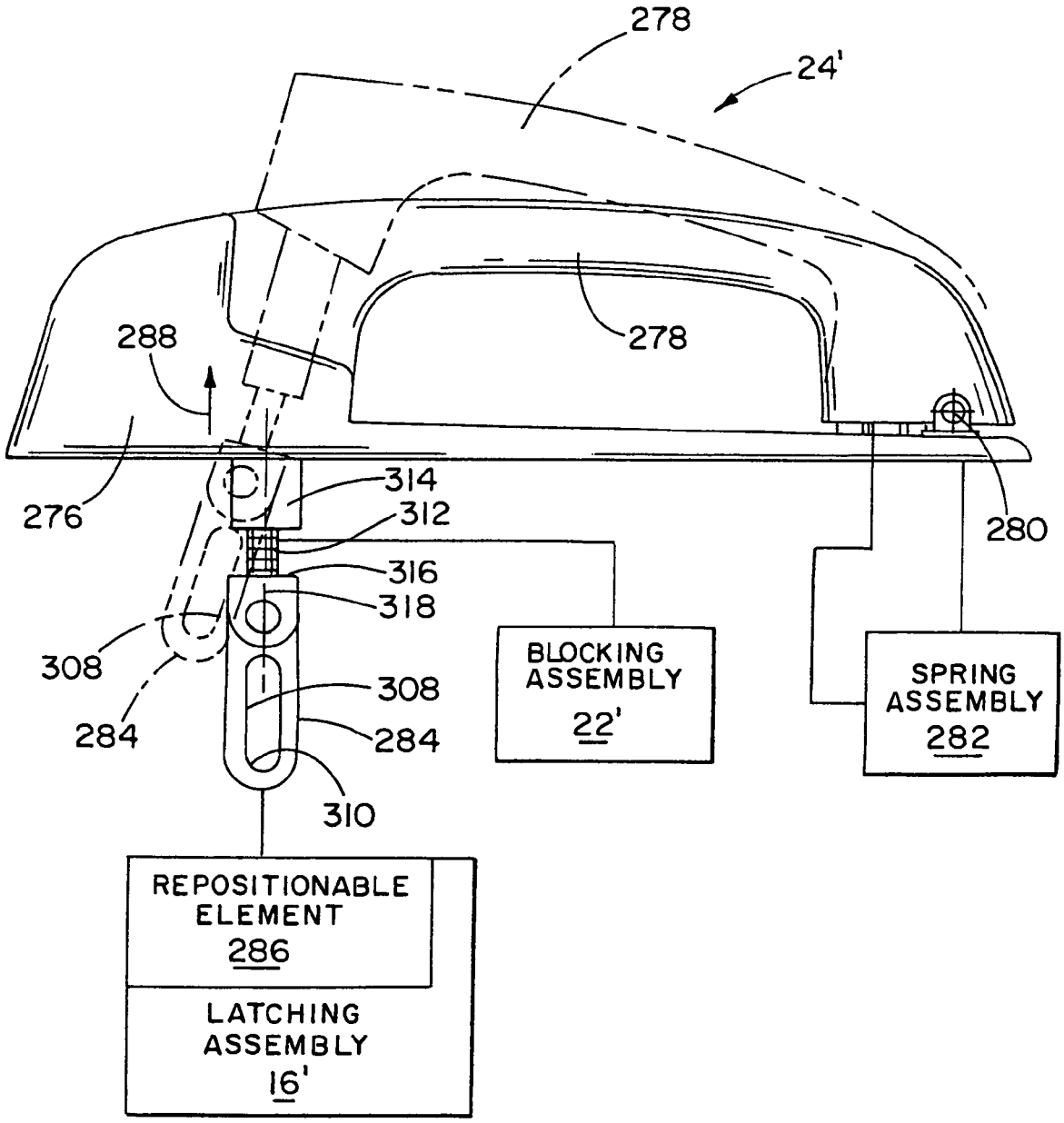
FIG. 31 is a partially schematic, elevation view of another frm of lock system, according to the invention, and including a modified form of first actuating assembly.
Figure 32:
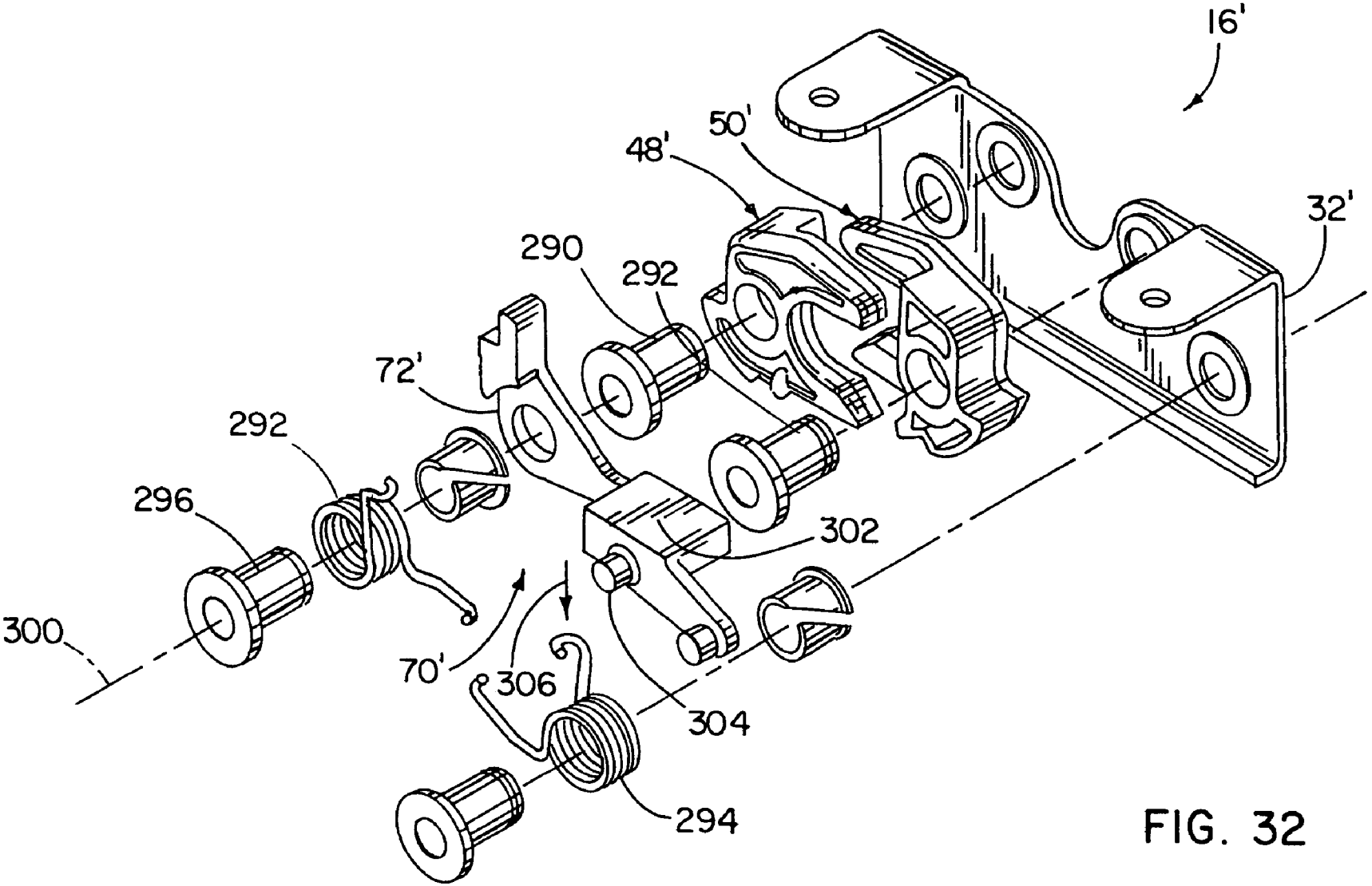
FIG. 32 is an exploded perspective view of a modified form of latching assembly, according to the present invention.
Figure 33:
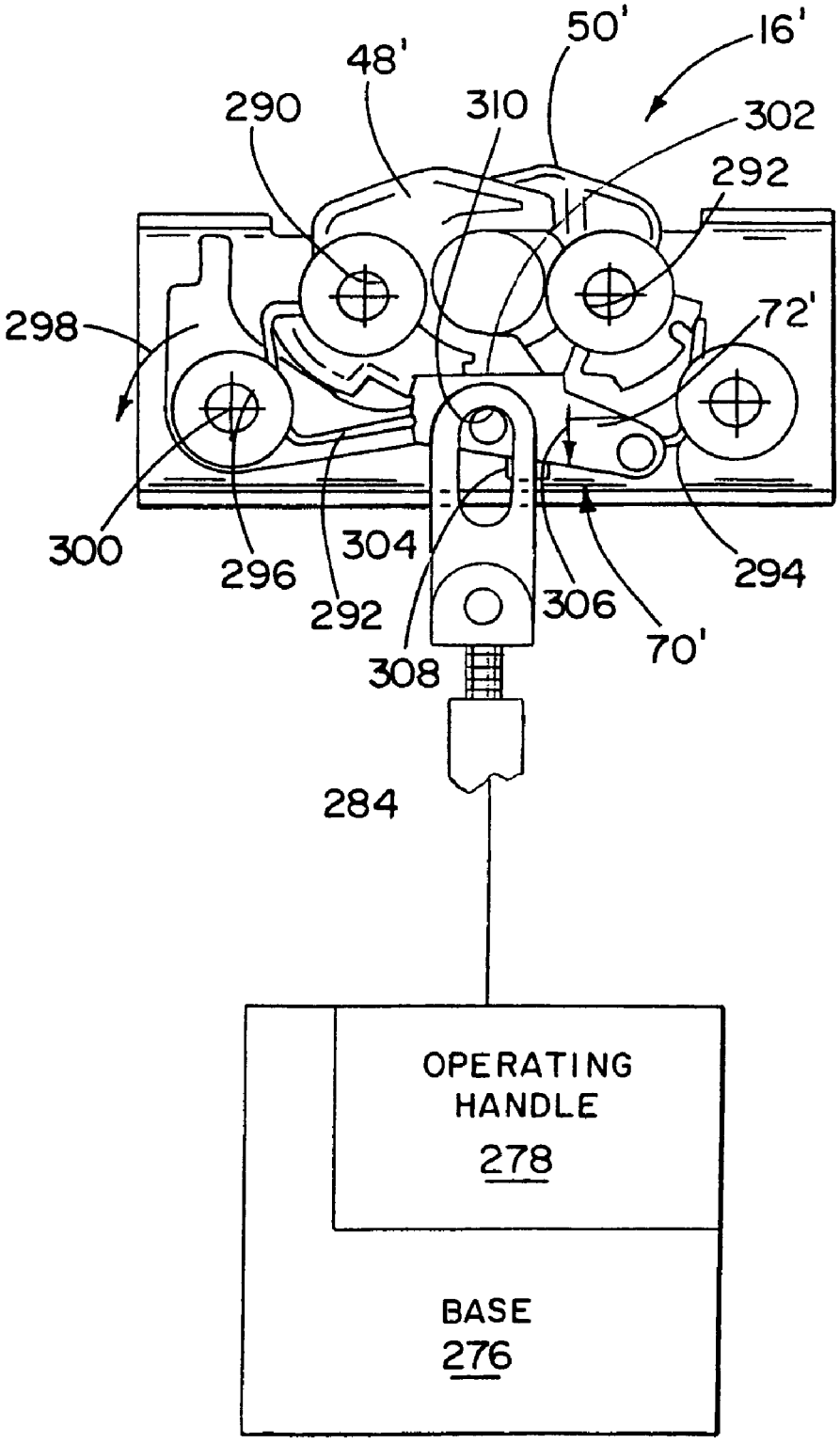
FIG. 33 is a partially schematic representation of the latching assembly of FIG. 32, in an assembled state and with rotors thereon in a latched position, and in operative relationship with the first actuating assembly of FIG. 31.

A modified form of first actuating assembly, according to the present invention, is shown at 24' in FIG. 31. The first actuating assembly 24' has a base 276 to which an operating handle 278 is hingedly joined for pivoting movement relative thereto around an axis 280. A spring assembly 282 normally urges the operating handle 278 to the solid line position in FIG. 31. The actuating assembly 24' has an actuating component 284 that follows movement of the operating handle 278 as it is pivoted between the solid and phantom line positions in FIG. 31. The actuating component 284 is engageable with a repositionable element 286, which is movable to change the latching assembly 16' from its first state into its second state. The repositionable element 286 is caused to effect the change of state of the latching assembly 16' in response to movement of the operating handle 278 from the solid line position into the phantom line position, which causes the actuating component 284 to move generally in the direction of the arrow 288.

A blocking assembly 22', made according to the present invention, has first and second different states, corresponding to those for the blocking assembly 22, and in a first state therefor, allows the repositionable element 286 to be moved to change the latching assembly 16' from the first state therefor into the second state, as an incident of the operating handle 278 moving from the solid line position into the phantom line position of FIG. 31. In the second state for the blocking assembly 22', the repositionable element 286 is prevented from moving, through repositioning of the operating handle 278, in such a manner that it causes the latching assembly 16' to change from its first state into its second state.

Details of the first actuating assembly 24' are shown in relationship to the modified form of blocking assembly 22' and latching assembly 16' in FIGS. 32–35. The latching assembly 16' has a housing 32' which mounts rotors 48', 50' for pivoting movement around axles 290, 292 between latched and release positions, corresponding to those for the previously described rotors 48, 50 . The rotors 48', 50' are normally biased into the release positions therefor by torsion coil springs 292, 294, respectively. A catch assembly 70' includes an L-shaped catch element 72', corresponding to the repositionable element 286 in FIG. 31, that is journalled for rotation around an axle 296. The coiled torsion springs 292, 294 normally bias the catch element 72' in the direction of the arrow 298 around an axis 300 defined by the axle 296. This causes a catch arm 302 to block the rotors 48', 50' in their latched positions.

The catch arm 302 has a cantilevered post 304 which, upon being urged in the direction of the arrow 306, pivots the catch element 72 around the axis 300 oppositely to the direction indicated by the arrow 298. As this occurs, the catch arm 302 clears away from the rotors 48', 50' to allow the same to be driven under the stored force in the coiled torsion springs 292, 294 to their release positions.

As shown also in FIG. 31, the actuating component 284 on the operating handle 276 has an oval through slot 308 dimensioned to receive the cantilevered post 304. With the cantilevered post 304 bearing on an edge 310 at one end of the slot 308, pivoting movement of the operating handle 278 from the solid line position of FIG. 31 into the phantom line position causes the cantilevered post 304 to be repositioned so as to pivot the catch element 72' from the FIG. 33 position to thereby allow pivoting of the rotors 48', 50' from their latched positions into their released positions.

The actuating component 284 is mounted to a threaded shaft 312 projecting from a cantilevered stem 314. By reason of the reduced diameter of the shaft 312 compared to the effective diameter of the actuating component 284, a shoulder 316 is defined around the stem 314 and faces axially with respect to the axis 318 of the threaded shaft 312. The shoulder 316 cooperates with the modified blocking system 22', as shown in detail in FIGS. 34 and 35.

The blocking assembly 22' differs from the blocking assembly 22 only by reason of the provision of a slot 320, that is contiguous with a cutout 270' on a plate 146', with the cutout 270' and plate 146' corresponding to the cutout 270 and plate 146 on the blocking assembly 22.

Figure 34:
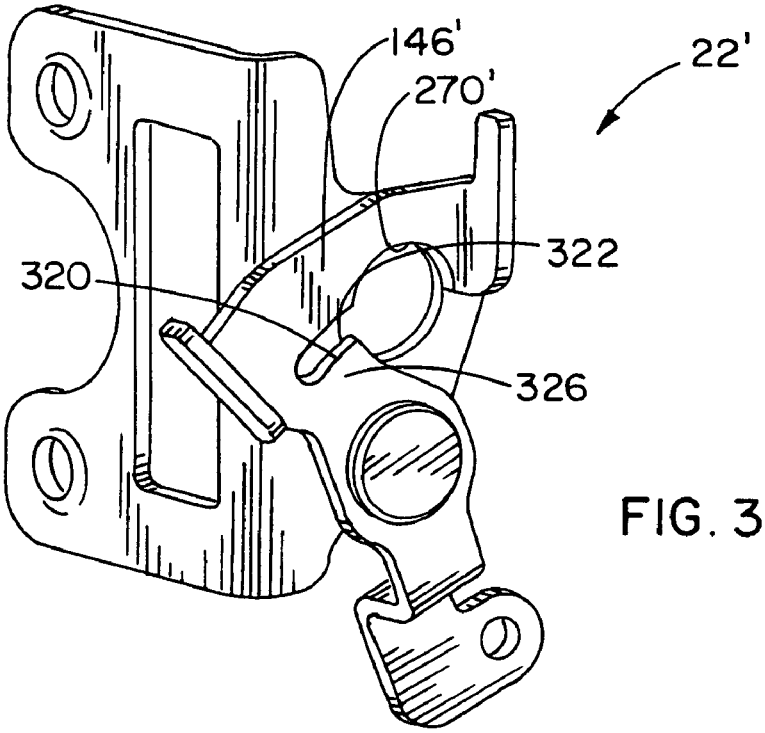
FIG. 34 is an enlarged, perspective view of a modified form of blocking assembly in a position corresponding to that for the blocking assembly in FIG. 12.
Figure 35:
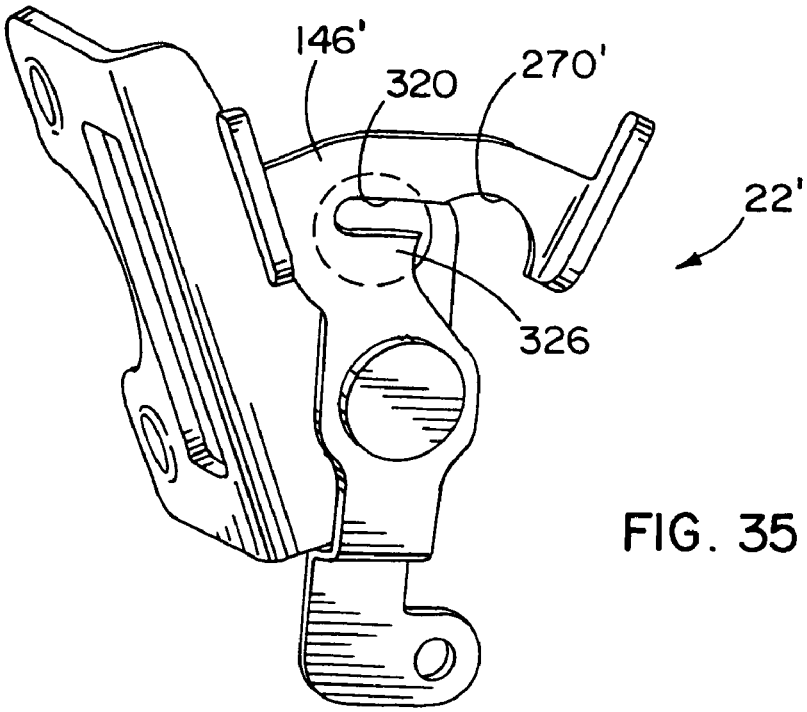
FIG. 35 is a view as in FIG. 34 with the blocking assembly in a state corresponding to that for the blocking assembly in FIG. 13.

The plate 146' is movable between a first position in FIG. 34, corresponding to that for the plate 146 in FIG. 12, to a second position, as shown in FIG. 35 and corresponding to that in FIG. 13. With the operating handle 278 in the solid line position of FIG. 31, the threaded shaft 312, carried by the operating handle 278, aligns with the slot 320. By changing the plate 146 from the first position into the second position, the threaded shaft 312 is caused to move into the slot 320, representing the locked state for the associated lock system. Attempted repositioning of the operating handle 278 from the solid line position to the phantom line position in FIG. 31 causes the shoulder 316 to encounter a facing surface 322 on the plate 146'. This prohibits movement of the actuating component 284 through its operating path in a range required to change the state of the latching assembly 16'.

The blocking assembly 22' is also usable in conjunction with the push button actuator 28, as previously described. As seen in FIGS. 17, 21 and 26, the threaded post 198 has a diameter to be movable within the slot 320. With the blocking assembly 22' in the FIG. 35 state and the post 198 residing within the slot 320, translation of the push button actuator 28 is blocked by reason of the surface 324 of the threaded nut 194 encountering the surface 326 on the plate 146', facing oppositely to the surface 324.

With this combination of components, a more efficient use of the actuating stroke for the push button actuator 28 potentially results. With the blocking assembly 22, the push button actuator 28 must be retracted a distance sufficient to clear out of the path of the plate 146'. With the blocking assembly 22', the distance for the "pull handle" arrangement of FIG. 31 can be reduced.

It should be understood that the invention contemplates many other variations of the first actuating assemblies 24, 24' shown. The inventive blocking assembly 22, 22' can be designed to selectively reside in the path of any element that is moved in translation, or may be modified to selectively block the path of an element moving other than in a translatory path i.e. by pivoting, to thereby prevent a change in the state of the latching assembly 16, 16', or a similarly configured latching assembly.

The foregoing disclosure of specific embodiments is intended to be illustrative of the broad concepts comprehended by the invention.

The invention claimed is:

1. A lock system for releasably maintaining a movable closure element in one of two different positions for the movable closure element relative to a support for the movable closure element, the lock system comprising:

a latching assembly having a first state and a second state, the latching assembly in the first state releasably engageable with a part on the support to thereby releasably maintain the movable closure element with which the lock system is associated in the one position, the latch assembly comprising a first element that is changed from a first position into a second position to thereby cause the latching assembly to be changed from the first state into the second state whereupon a movable closure element with which the lock system is associated can be moved from the one position into the other of the two different positions; and an actuating system for the latching assembly, the actuating system comprising a first actuating assembly that is changeable from a first state into a second state by movement of a part of the first actuating assembly in an operating path from one position into another position to thereby cause the first element to be changed from the first position into the second position, wherein the first actuating assembly comprises a push button actuator that is movable from a normal position into an actuated position to change the first actuating assembly from the first state into the second state, the actuating system further comprising a blocking assembly having a first state and a second state, the blocking assembly in the first state allowing the first actuating assembly to be changed from the first state into the second state, the blocking assembly in the second state blocking the operating path to prevent the part of the first actuating assembly from being changed from the one position into the another position and the push button actuator from being moved from the normal position into the actuated position and thereby the first actuating assembly from being changed from the first state into the second state.

2. The lock system according to claim 1 in combination with a movable closure element upon which the lock system is operatively mounted.

3. The lock system according to claim 2 further in combination with a support relative to which the movable closure element is mounted for movement between the two different positions.

4. The lock system according to claim 3 wherein the support comprises a strike assembly with a part that is releasably engaged by the latch assembly with the latch assembly in the first state to thereby releasably maintain the movable closure element in the one position.

5. The lock system according to claim 4 wherein the latching assembly comprises at least one rotor with a receptacle for the part of the strike assembly, the at least one rotor pivotable around an axis between a latched position and a release position, the at least one rotor in the latched position with the latching assembly in the first state and in the release position with the latching assembly in the second state.

6. The lock system according to claim 1 wherein the latching assembly comprises a second actuating assembly for changing the blocking assembly between the first and second states.

7. The lock system according to claim 6 wherein the second actuating assembly is operable to change the blocking assembly between the first and second states in response to transmission of an electrical signal from an input.

8. The lock system according to claim 7 wherein the second actuating assembly comprises a drive that is operable in response to a transmission of the electrical signal from the input to the first actuator.

9. The lock system according to claim 7 wherein the input comprises a key pad.

10. The lock system according to claim 7 wherein the input comprises a wireless transmitter for the electrical signal.

11. The lock system according to claim 7 wherein the input comprises a wired switch.

12. The lock system according to claim 1 wherein the part of the first actuating assembly is translated in the operating path to drive the first element from the first position into the second position.

13. The lock system according to claim 2 wherein the first actuating system comprises a self-contained module that is separate from the blocking assembly and is operably assembled by translating the self-contained module relative to the closure element, whereupon the first actuating assembly and a remainder of components on the lock system become operably related without requiring securing of any part of the self-contained module to any of the remainder of the components.

14. The lock system according to claim 1 wherein the part of the first actuating assembly follows movement of the push button actuator so that the part of the first actuating assembly moves in the operating path as the push button moves from the normal position to the actuated position.

15. A lock system for releasably maintaining a movable closure element in one of two different positions for the movable closure element relative to a support for the movable closure element, the lock system comprising:

a latching assembly having a first state and a second state, the latching assembly in the first state releasably engageable with a part on the support to thereby releasably maintain the movable closure element with which the lock system is associated in the one position, the latching assembly comprising a first element that is changed from a first position into a second position to thereby cause the latching assembly to be changed from the first state into the second state whereupon a movable closure element with which the lock system is associated can be moved from the one position into the other of the two different positions; and an actuating system for the latching assembly, the actuating system comprising a first actuating assembly that is changeable from a first state into a second state by movement of a part of the first actuating assembly in an operating path from one position to another position to thereby cause the first element to be changed from the first position into the second position, the actuating system further comprising a blocking assembly having a first state and a second state, the blocking assembly in the first state allowing the first actuating assembly to be changed from the first state into the second state, the blocking assembly in the second state blocking the operating path to prevent the part of the first actuating assembly from being changed from the one position into the another position and thereby the first actuating assembly from being changed from the first state into the second state, wherein the latching assembly comprises a second actuating assembly for changing the blocking assembly between the first and second states, wherein the first actuating assembly comprises a push button actuator that is movable from a normal position into an actuated position to change the first actuating assembly from the first state into the second state, wherein the part of the first actuating assembly is translated in the operating path to drive the first element from the first position into the second position, wherein the first actuating assembly is changeable from the first state into a third state to thereby change the blocking assembly when in its second state into its first state.

16. The lock system according to claim 15 wherein the first actuating assembly is changeable from the first state into a fourth state to thereby change the blocking assembly into the second state.

17. The lock system according to claim 15 wherein the actuating system comprises a second actuating assembly for changing the blocking assembly between the first and second states.

18. The lock system according to claim 17 wherein the push button actuator is movable from the normal position into the actuated position along a first line and the first actuating assembly is changeable from the first state into the third state by pivoting movement of the push button actuator around a first axis that is substantially parallel to the first line.

19. The lock system according to claim 18 wherein the first actuating assembly comprises a cam element that engages a first surface on the blocking assembly and changes the blocking assembly from the second state into the first state as an incident of the first actuating assembly changing from the first state into the third state.

20. The lock system according to claim 19 wherein the blocking assembly comprises a plate that is pivotable about a second axis that is substantially parallel to the first axis between a first position with the blocking assembly in the first state and a second position with the blocking assembly in the second state.

21. The lock system according to claim 20 wherein the plate has a wall having a surface residing substantially in a first plane and the first surface projects angularly away from the first plane.

22. The lock system according to claim 21 wherein the blocking assembly comprises a second surface that projects angularly away from the first plane and is spaced from and faces the first surface and the cam element engages the second surface and changes the blocking assembly from the first state into the second state as an incident of the first actuating assembly changing from the first state into a fourth state, wherein the plate is in the second position.

23. The lock system according to claim 22 wherein with the blocking assembly in the first state, the part of the first actuating assembly is movable along the first line towards and past the first plane to engage and cause the first element to be changed from the first position into the second position as the push button actuator is moved from the normal position into the actuated position.

24. The lock system according to claim 22 wherein with the blocking assembly in the second state, the part of the first actuating assembly is blocked by the plate wall from moving in the operating path to cause the first element to be changed from the first position into the second position.

25. The lock system according to claim 19 wherein the cam element projects in cantilever fashion away from the first axis in a direction transverse to the first line.

26. The lock system according to claim 19 wherein a portion of the first actuating assembly is pivotable around the first axis to change the first actuating assembly from the first state into the third state.

27. The lock system according to claim 20 wherein a portion of the first actuating assembly is a) pivotable around the first axis in a first direction to change the first actuating assembly from the first state into the third state and b) pivotable around the first axis in a direction opposite to the first direction to change the first actuating assembly from the first state into the fourth state.

28. The lock system according to claim 27 wherein the portion of the first actuating assembly comprises the push button actuator.

29. The lock system according to claim 28 wherein the push button actuator is pivoted around the first axis in the first direction to a first position to change the first actuating assembly from the first state into the third state and pivoted in a direction opposite to the first direction to a second position to change the first actuating assembly from the first state into the fourth state, and the push button actuator is spring biased to a resting position between the first and second position.

30. The lock system according to claim 29 wherein the push button actuator has an associated key operated cylinder that moves guidingly within a case and with a key operatively inserted into the cylinder, the push button actuator can be pivoted between the first and second positions.

31. The lock system according to claim 29 wherein the key can be removed from the cylinder with the push button actuator in the third position and cannot be removed from the cylinder with the push button actuator in either of the first and third positions.

32. The lock system according to claim 30 wherein the first actuating assembly further comprises a housing, the push button actuator is mounted for movement relative to the housing between the normal position and actuated position and the push button actuator and housing are keyed to each other against relative movement around the first axis.

33. The lock system according to claim 32 wherein the push button actuator and housing are selectively keyed to each other against relative pivoting around the first axis in two different relative positions.

34. The lock system according to claim 32 wherein the housing defines a graspable handle.

35. A lock system for releasably maintaining a movable closure element in one of two different positions for the movable closure element relative to a support for the movable closure element, the lock system comprising:

a latching assembly having a first state and a second state, the latching assembly in the first state releasably engageable with a part of the support to thereby releasably maintain the movable closure element with which the lock system is associated in the one position, the latch assembly comprising a first element that is changed from a first position into a second position to thereby cause the latching assembly to be changed from the first state into the second state whereupon a movable closure element with which the lock system is associated can be moved from the one position into the other of the two different positions; and an actuating system for the latching assembly, the actuating system comprising a first actuating assembly that is changeable from a first state into a second state by movement of a part of the first actuating assembly in an operating path to thereby cause the first element to be changed from the first position into the second position, the actuating system further comprising a blocking assembly having a first state and a second state, the blocking assembly in the first state allowing the first actuating assembly to be changed from the first state into the second state, the blocking assembly in the second state blocking the operating path to prevent the part of the first actuating assembly from being changed from the first position into the second position and thereby the first actuating assembly from being changed from the first state into the second state, the actuating system further comprising a second actuating assembly for changing the blocking assembly between the first and second states, wherein the part of the first actuating assembly is translated in the operating path and drives the first element from the first position into the second position as an incident of the first actuating assembly changing from the first state into the second state, wherein the first actuating system comprises a self-contained module that is separate from the blocking assembly, wherein the self-contained module can be installed as a unit and operably assembled with the blocking assembly without requiring any separate fastener acting between the blocking assembly and first actuating assembly.

36. The lock system according to claim 35 wherein the first actuating assembly and blocking assembly are changeable from a fully separated state into an operably assembled state by relative translational movement between the first actuating assembly and blocking assembly.

37. The lock system according to claim 36 wherein the first actuating assembly comprises a push button actuator that is repositionable to thereby engage and reposition a part of the latch assembly to thereby cause the first element to move from the first position into the second position.

38. A lock system for releasably maintaining a movable closure element in one of two different positions for the movable closure element relative to a support for the movable closure element, the lock system comprising:

a latching assembly having a first state and a second state, the latching assembly in the first state releasably engageable with a part on the support to thereby releasably maintain the movable closure element with which the lock system is associated in the one position, the latch assembly comprising a first element that is changed from a first position into a second position to thereby cause the latching assembly to be changed from the first state into the second state whereupon a movable closure element with which the lock system is associated can be moved from the one position into the other of the two different positions; and an actuating system for the latching assembly, the actuating system comprising a first actuating assembly that is changeable from a first state into a second state by movement of a part of the first actuating assembly in an operating path from one position to another position to thereby cause the first element to be changed from the first position into the second position, the actuating system further comprising a blocking assembly having a first state and a second state, the blocking assembly in the first state allowing the first actuating assembly to be changed from the first state into the second state, the blocking assembly in the second state blocking the operating path to prevent the part of the first actuating assembly from being changed from the one position into the another position and thereby the first actuating assembly from being changed from the first state into the second state, the blocking assembly comprising a plate that is pivotable about an axis between a first position with the blocking assembly in the first state and a second position with the blocking assembly in the second state, the plate in the first position residing in the operating path to block movement of the part of the first actuating assembly from the one position to the another position, the plate in the second position allowing the part of the first actuating assembly to be moved from the one position into the another position.

39. The lock system according to claim 38 wherein the first actuating assembly comprises a push button actuator that is movable from a normal position into an actuated position to change the first actuating assembly from the first state into the second state, wherein the part of the first actuating assembly is translated in the operating path to drive the first element from the first position into the second position, wherein the push button actuator is movable from the normal position into the actuated position along a first line, wherein the first line is substantially parallel to the axis about which the plate pivots.

* * * * *

UNITED STATES PATENT AND TRADEMARK OFFICE

CERTIFICATE OF CORRECTION

PATENT NO. : 7,234,329 B2
APPLICATION NO. : 10/811692
DATED : June 26, 2007
INVENTOR(S) : Ricci L. Marzolf et al.

It is certified that error appears in the above-identified patent and that said Letters Patent is hereby corrected as shown below:

Title Page item 75
The name of the first inventor should be:

RICCI L. MARZOLF

Signed and Sealed this

Thirtieth Day of October, 2007

JON W. DUDAS
*Director of the United States Patent and Trademark Office*